US010399803B2

(12) United States Patent
Nakada et al.

(10) Patent No.: US 10,399,803 B2
(45) Date of Patent: Sep. 3, 2019

(54) FEEDING DEVICE, IMAGE FORMING SYSTEM, AND CONVEYED MEDIUM INSPECTION SYSTEM

(71) Applicant: RICOH COMPANY, LTD., Tokyo (JP)

(72) Inventors: Kyosuke Nakada, Kanagawa (JP); Kiyoshi Hata, Tokyo (JP); Mamoru Yorimoto, Kanagawa (JP); Yuichiro Maeyama, Kanagawa (JP); Isao Matsushima, Kanagawa (JP); Takeshi Watanabe, Kanagawa (JP); Kahei Nakamura, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 6 days.

(21) Appl. No.: 15/411,113

(22) Filed: Jan. 20, 2017

(65) Prior Publication Data

US 2017/0210578 A1 Jul. 27, 2017

(30) Foreign Application Priority Data

Jan. 25, 2016 (JP) ..... 2016-011642

(51) Int. Cl.
*B65H 3/08* (2006.01)
*B65H 7/02* (2006.01)
(Continued)

(52) U.S. Cl.
CPC ..... *B65H 3/08* (2013.01); *B65H 3/0816* (2013.01); *B65H 3/0883* (2013.01); *B65H 3/128* (2013.01);
(Continued)

(58) Field of Classification Search
CPC ..... B65H 3/12; B65H 3/08; B65H 3/0816; B65H 3/0833; B65H 5/22; B65H 5/222;
(Continued)

(56) References Cited

U.S. PATENT DOCUMENTS 5,893,554 A * 4/1999 Okahashi ..... B65H 3/128 271/104
6,318,052 B1 * 11/2001 Kuhar ..... B65H 3/128 53/570
(Continued)

FOREIGN PATENT DOCUMENTS

JP 2011-236052 11/2011
JP 2014-152023 8/2014
(Continued)

*Primary Examiner* — Thomas A Morrison
(74) *Attorney, Agent, or Firm* — Oblon, McClelland, Maier & Neustadt, L.L.P.

(57) ABSTRACT

A feeding device includes a plurality of suction units, disposed above a conveyed medium stacked on a stacker, to attract the conveyed medium. At least one of the plurality of suction units includes a rotary fan including a board and a plurality of walls extending from the board; and a driver to rotate the rotary fan. The at least one of the plurality of suction units generates a vortex air with a side of the board with the plurality of walls directed to the conveyed medium. The at least one of the plurality of suction units being a suction unit generates a vortex air.

20 Claims, 30 Drawing Sheets

(51) Int. Cl.
*G03G 15/00* (2006.01)
*B65H 3/12* (2006.01)

(52) U.S. Cl.
CPC ..... *B65H 7/02* (2013.01); *G03G 15/6511* (2013.01); *G03G 15/6529* (2013.01); *B65H 2405/15* (2013.01); *B65H 2406/3122* (2013.01); *B65H 2406/363* (2013.01); *B65H 2406/36625* (2013.01); *B65H 2511/11* (2013.01); *B65H 2511/22* (2013.01); *G03G 2215/004* (2013.01); *G03G 2215/00396* (2013.01); *G03G 2215/0129* (2013.01)

(58) Field of Classification Search
CPC ..... B65H 5/228; B65H 2406/30; B65H 2406/31; B65H 2406/323; B65H 2406/36; B65H 2406/363; B65H 2406/3662
See application file for complete search history.

(56) References Cited

U.S. PATENT DOCUMENTS

| | | | | |
|---|---|---|---|---|
| 8,387,968 | B2 * | 3/2013 | Fujikura | B65H 1/14 271/157 |
| 2011/0272877 | A1 * | 11/2011 | Wardak | B65H 3/128 271/12 |
| 2014/0312557 | A1 * | 10/2014 | Ishikawa | B65H 1/14 271/18.1 |
| 2015/0225193 | A1 * | 8/2015 | Haeussler | B26D 7/018 294/183 |

FOREIGN PATENT DOCUMENTS

| | | |
|---|---|---|
| JP | 2015-502304 | 1/2015 |
| WO | WO2013/068307 A1 | 5/2013 |

* cited by examiner

FEEDING DEVICE, IMAGE FORMING SYSTEM, AND CONVEYED MEDIUM INSPECTION SYSTEM

CROSS-REFERENCE TO RELATED APPLICATION

The present application claims priority pursuant to 35 U.S.C. § 119(a) from Japanese patent application number 2016-011642, filed on Jan. 25, 2016, the entire disclosure of which is incorporated by reference herein.

BACKGROUND

Technical Field

Exemplary embodiments of the present disclosure relate to a feeding device, an image forming system, and a conveyed medium inspection system.

Background Art

A feeding device to feed a conveyed medium to an image forming system such as a copier or a printer and to an inspection device may include a suction device to feed a topmost medium forward using air suction method, and a conveyance device to convey the medium in a conveyance direction.

The feeding device according to the present disclosure includes a plurality of suction units, disposed above a conveyed medium, to attract a conveyed medium. Each suction unit includes a board and a rotary fan having a plurality of walls extending from the board and a driver to rotate the rotary fan, in which a face on which the walls extend, is disposed facing a topmost conveyed medium, and a vortex air is generated. The feeding device includes at least one suction unit described above.

SUMMARY

In one embodiment of the disclosure, provided is an improved feeding device includes a plurality of suction units, disposed above a conveyed medium stacked on a stacker, to attract the conveyed medium. At least one of the plurality of suction units includes a rotary fan including a board and a plurality of walls extending from the board; and a driver to rotate the rotary fan. The at least one of the plurality of suction units generates a vortex air with a side of the board with the plurality of walls directed to the conveyed medium.

In another embodiment of the present disclosure, provided is an improved feeding device including a plurality of suction units, disposed above a conveyed medium stacked on a stacker, to attract the conveyed medium, and at least one of the plurality of suction units being a suction unit generates a vortex air.

In further another embodiment of the present disclosure, provided is an optima feeding device including a first suction unit that includes a suction chamber; a suction fan to exhaust air from the suction chamber; and a first driver to rotate the suction fan; and a second suction unit that includes a rotary fan including a board and a plurality of walls extending from the board; and a second driver to rotate the rotary fan. The second suction unit generates a vortex air with a side of the board with the plurality of walls directed to a conveyed medium, and the first suction unit and the second suction unit are disposed above the conveyed medium stacked on a stacker to attract the conveyed medium.

These and other features and advantages of the present disclosure will become apparent upon consideration of the following description of embodiments of the present disclosure when taken in conjunction with the accompanying drawings.

BRIEF DESCRIPTION OF THE DRAWINGS

The aforementioned and other aspects, features, and advantages of the present disclosure would be better understood by reference to the following detailed description when considered in connection with the accompanying drawings, wherein.

DETAILED DESCRIPTION

Figure 1:
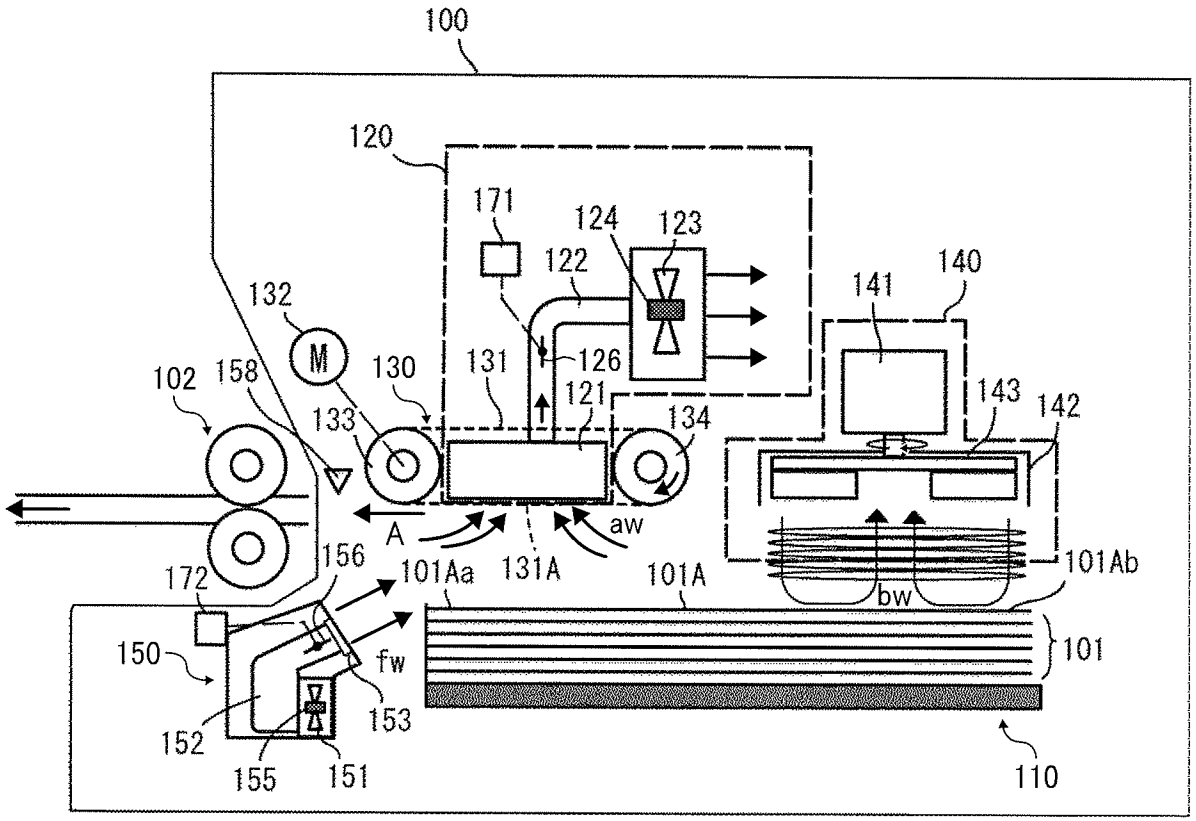
FIG. 1 schematically illustrates a feeding device according to the first embodiment of the present disclosure.

Hereinafter, embodiments of the present disclosure will be described with reference to accompanying drawings. In each embodiment, the same reference numeral is applied to the same or equivalent part, and redundant explanation is omitted as appropriate. Each drawing may be partly omitted to help better understand the structure.

In the conventional feeding device, when suction units employing various air aspiration methods attract and convey a conveyed medium, conveyance of the medium starts after separation air blown from a separator or a fan blows to a trailing edge of the conveyed medium. This is because, when the conveyed medium starts to be conveyed before completion of separation of the conveyed medium, a following medium tends to be conveyed following the not-fully-separated medium due to friction between the conveyed media. However, waiting until the separation air blows through the trailing edge of the conveyed medium results in delay of feeding the medium and prevents improvement of efficiency. Accordingly, the feeding device according to the embodiments of the present disclosure includes a plurality of suction units disposed above the conveyed medium stacked in the stacker and attracting the conveyed medium. The suction unit includes a rotary fan having a board and a plurality of walls standing from the board, and a driver to rotate the rotary fan, and includes at least one suction unit to generate a vortex air, with a face with standing walls faced to the topmost conveyed medium. Specifically, the feeding device includes a plurality of suction devices, such as a first suction unit employing a conventional air suction method, and a second suction unit employing a vortex air suction method that is different from the method of the first suction unit. With the first and second suction units using different suction methods, the topmost conveyed medium stacked on the stacker is attracted. As a result, because at least one suction unit to generate the vortex air is disposed among the plurality of suction units, the attracting property to the conveyed medium can be improved and a new feeding device with good separation of the conveyed medium can be provided.

Further, compared to the conventional structure, the second suction unit improves both the adsorption and separation the topmost conveyed medium, and a new feeding device with good separation of the conveyed medium, reduction of the separation time, and prevention of misfeeding the conveyed medium, is provided.

First Embodiment

A structure of a feeding device 100 according to the present embodiment will be described. As illustrated in FIG. 1, the feeding device 100 includes, in an inside thereof, a stacker 110 on which a sheet-shaped conveyed medium 101 is stacked, a first suction unit 120, a conveyance device 130, a second suction unit 140, a fan 150 as a separator, and a controller 200 (see FIG. 11). In the following description, the word "media" may be employed if appropriate.

Figure 2:
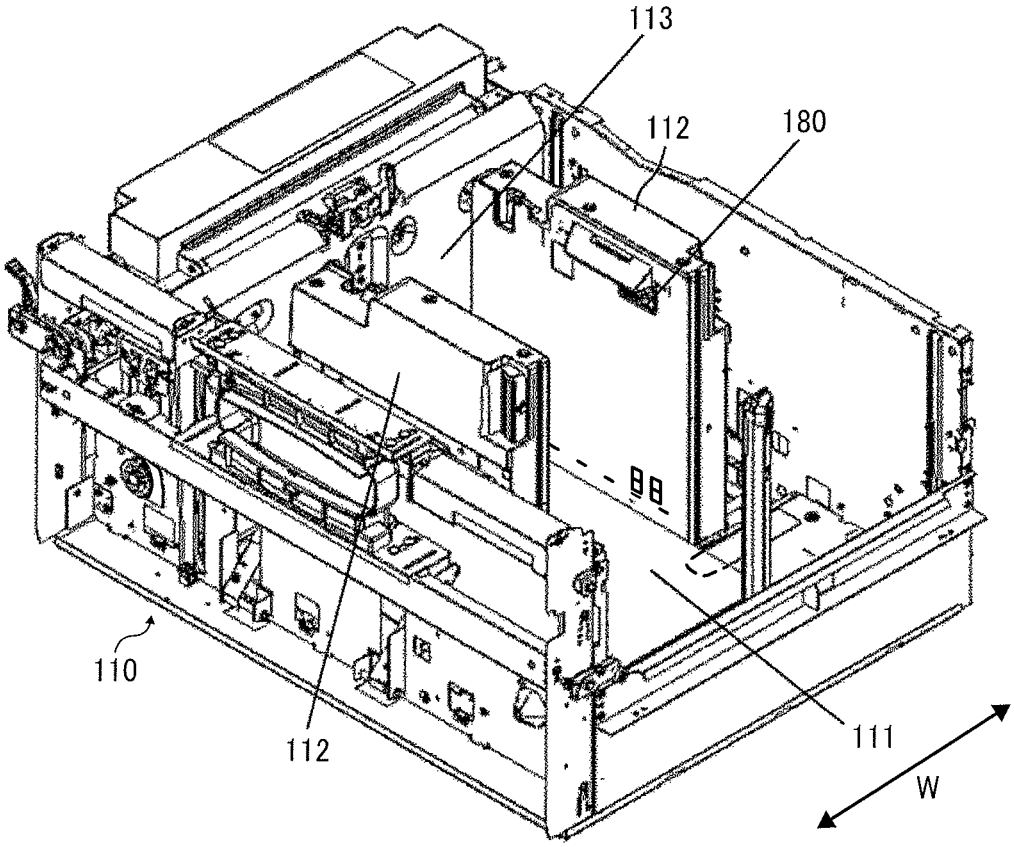
FIG. 2 is a perspective view illustrating a stacker of the feeding device.

The first suction unit 120 attracts a topmost conveyed medium 101 by generating a negative pressure to a suction chamber 121. The conveyance device 130 conveys the conveyed medium 101 in a conveyance direction A as indicated by arrow A, to another system positioned in the conveyance direction A. The second suction unit 140 attracts the conveyed medium 101 with a vortex air. That is, the feeding device 100 according to the present embodiment includes two different types of suction units. The stacker 110 serves to stack a plurality of conveyed media 101 thereon. As illustrated in FIG. 2, the stacker 110 includes a lifting tray 111 including a lifting device that moves up and down in accordance with a remaining number of stacked media, so that the topmost conveyed medium 101A is kept with a constant height. The stacker 110 includes a pair of side fences 112 and 112, and a contact member 113. A distance between the pair of side fences 112 and 112 is variable corresponding to the width W of the conveyed medium 101. The contact member 113 is used to contact an end of the conveyed medium 101 and align a leading edge of the conveyed medium 101. The arrow W is directed to a direction crossing the conveyance direction A.

Figure 3:
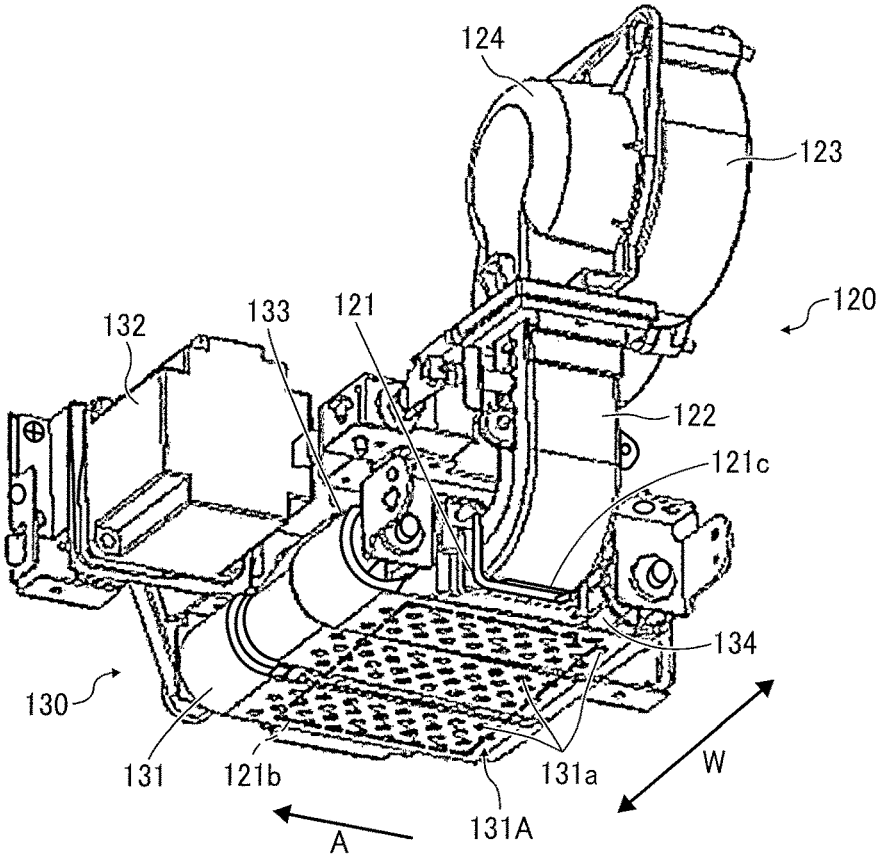
FIG. 3 is a perspective view illustrating an embodiment of a first suction unit and a conveyance device.

As illustrated in FIGS. 1 and 3, the first suction unit 120 includes the suction chamber 121, a suction duct 122, a suction fan 123, and a first driver 124. The first suction unit 120 is positioned above the conveyed medium 101 stacked on the stacker 110. The first suction unit 120 drives the first driver 124 to rotate the suction fan 123, so that the suction chamber 121 generates a negative pressure via air aspiration method, which is a so-called chamber method. The first suction unit 120 attracts the topmost conveyed medium 101A of the stacked conveyed media 101 via the generated negative pressure. The suction chamber 121 is disposed inside the conveyance device 130, and air communicates from an opening 121*b* formed in a bottom 121*a* via multiple small-diameter holes 131*a* formed on the conveyance device 130 to a lower space. A hole 121*c* is formed in one side in the width direction W of the suction chamber 121 perpendicular to the conveyance direction. The hole 121*c* is connected to the suction fan 123 and the first driver 124 via the suction duct 122.

In the first suction unit 120, the first driver 124 rotates the suction fan 123, so that the air is sucked from the bottom of the conveyance device 130 and the sucked air is discharged outside the first suction unit 120 via the suction chamber 121, the suction duct 122, the suction fan 123, and the first driver 124. As illustrated in FIG. 1, a reference "aw" illustrates a flow of air or sucked air generated by operation of the first suction unit 120. The first suction unit 120 includes an electrically operated shutter device 126 that opens and closes the suction duct 122 or the suction chamber 121. The shutter device 126 is operated to open or close by a shutter driver 171. The first suction unit 120 is configured such that the suction force exerted by the airflow "aw" is exerted on a leading edge 101Aa of the conveyed medium 101A due to an operation of the shutter driver 171 when the first driver 124 is operated. Naturally enough, without providing the shutter device 126 or the shutter driver 171, the suction force can be exerted on the conveyed medium 101A by turning on or off the first driver 124. However, there is a time lag from the start of rotation of the suction fan 123 to the generation of the suction force or the negative pressure to attract the conveyed medium 101A. As a result, while the first driver 124 is retained to be driven, the shutter driver 171 turns on or off the shutter device 126, to thereby adjust a timing in which the suction force is exerted. This method is preferable for a higher speed operation.

Figure 4:
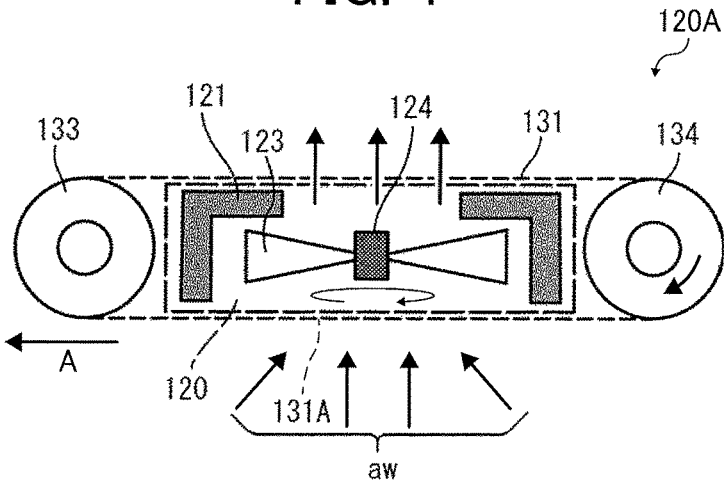
FIG. 4 schematically illustrates another embodiment of the first suction unit.

The first suction unit 120 is not limited to the embodiments illustrated in FIGS. 1 and 3, but may have another structure. For example, the first suction unit 120A as illustrated in FIG. 4 does not include a suction duct 122 compared to the first suction unit 120 illustrated in FIG. 3. In a case of using the first suction unit 120A, the first driver 124 rotates the suction fan 123, so that the air is attracted from a part lower than the suction fan 123 as illustrated in FIG. 4 and is discharged upward in FIG. 4. As a result, a negative pressure is generated inside the suction chamber 121, and the leading edge 101Aa of the conveyed medium 101A is attracted.

As illustrated in FIG. 1, the conveyance device 130 includes a conveyor belt 131 to convey the leading edge 101Aa of the conveyed medium 101 by a suction force being a negative pressure generated by the first suction unit 120, and a belt drive motor 132 as a belt driver to rotate the conveyor belt 131. The conveyor belt 131 includes multiple small-diameter holes 131*a*, through which the airflow "aw" generated by the first suction unit 120 passes. The conveyor belt 131 is stretched with tension between at least two rollers 133 and 134. The belt drive motor 132 drives to rotate one of the two rollers 133 and 134, so that the conveyor belt 131 rotates in the clockwise direction as illustrated in FIGS. 1 and 3. In the present embodiment, the belt drive motor 132 drives to rotate the roller 133. The conveyance device 130 attracts the topmost medium 101A attracted upward by the first suction unit 120 on a suction face 131A of the conveyor belt 131 opposed to the conveyed medium 101A. The belt drive motor 132 drives and the conveyed medium 101A attracted by the suction face 131A is conveyed in the conveyance direction A.

Figure 5:
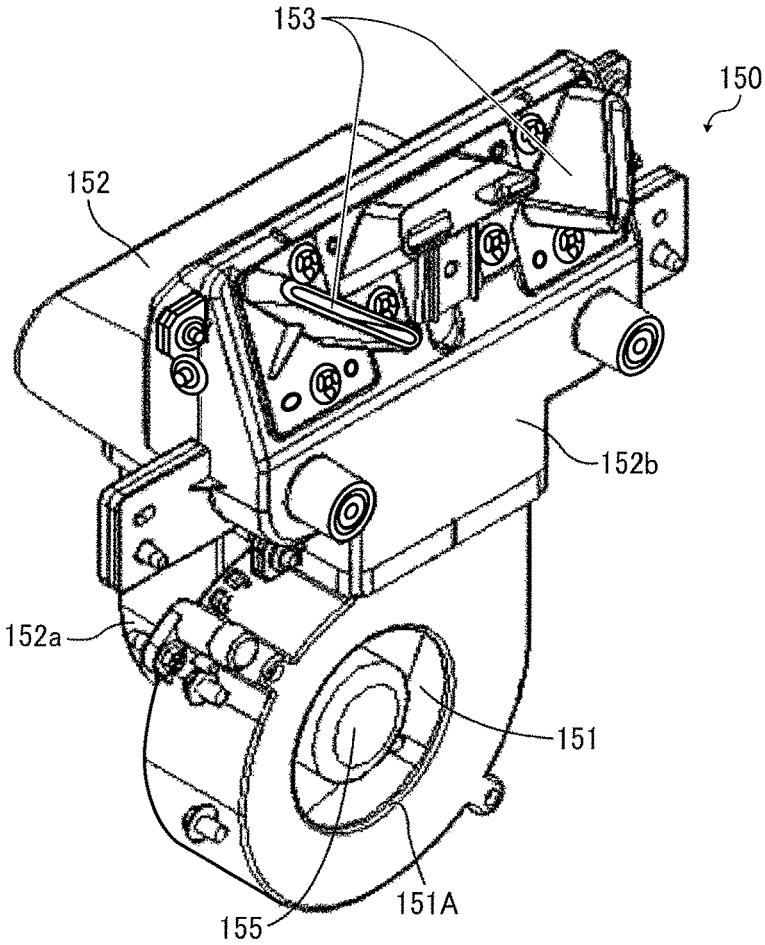
FIG. 5 is a perspective view illustrating a structure of a separator.

As illustrated in FIG. 1, the fan 150 blows an airflow "fw" as a separation air to a leading edge 101Aa of the topmost conveyed medium 101A at a matched timing with which the first suction unit 120 attracts the topmost conveyed medium 101A stacked on the stacker 110. The fan 150 blows the airflow "fw" against the leading edge 101Aa of the topmost conveyed medium 101A, so that the airflow "fw" is introduced between the conveyed medium 101A and the conveyed medium 101 disposed below the conveyed medium 101A, to thereby float the conveyed medium 101A toward the conveyance device 130. Herein, a reference 101Ab denotes a trailing edge of the conveyed medium 101A in the conveyance direction. As illustrated in FIGS. 1 and 5, the fan 150 includes a blast fan 151 that rotates driven by the fan drive motor 155, a blast duct 152 including an end 152*a* that connects to the blast fan 151, and a blast nozzle 153 that connects to another end 152*b* of the blast duct 152. The blast fan 151 of the fan 150 drives to rotate, so that the outside air is attracted from the opening 151A of the blast fan 151, and the airflow "fw" is discharged from the opening 151A of the blast nozzle 153 via the blast duct 152. The airflow "fw" is blown to the leading edge 101Aa of the topmost conveyed medium 101A (and the conveyed medium 101 overlaid below the topmost conveyed medium 101A), the topmost conveyed medium 101A is away from the conveyed medium 101 disposed below due to a positive pressure of the airflow "fw" and floats upward. The first suction unit 120 disposed above the conveyed medium 101A attracts the conveyed medium 101A, thereby accelerating attraction of the topmost conveyed medium 101A toward the suction face 131A of the conveyor belt 131 of the conveyance device 130.

As illustrated in FIG. 1, the fan 150 includes an electrically operated shutter device 156 that opens and closes the blast duct 152 or the blast nozzle 153. The shutter device 156 is operated to open or close by a fan shutter driver 172. The fan 150 is configured such that the airflow "fw" is blown from the blast nozzle 153 when the fan shutter driver 172 is turned on or off in a state in which the fan drive motor 155 is operated. Naturally enough, without providing the shutter device 156 or the fan shutter driver 172, the airflow "fw" can be blown to the leading edge 101Aa of the conveyed medium 101A by turning on or off the fan drive motor 155, but there is a time lag between the start of the rotation of the blast fan 151 and the time when the amount of air necessary to separate the conveyed medium 101A has been generated. As a result, it is preferable that the timing to blow the airflow "fw" be adjusted by opening or closing the shutter device 156 by the fan shutter driver 172. That is, the fan 150 is disposed at the first suction unit 120 and blows the airflow "fw" being a separating air to the leading edge 101Aa of the conveyed media 101, 101A before suction.

Figure 6:
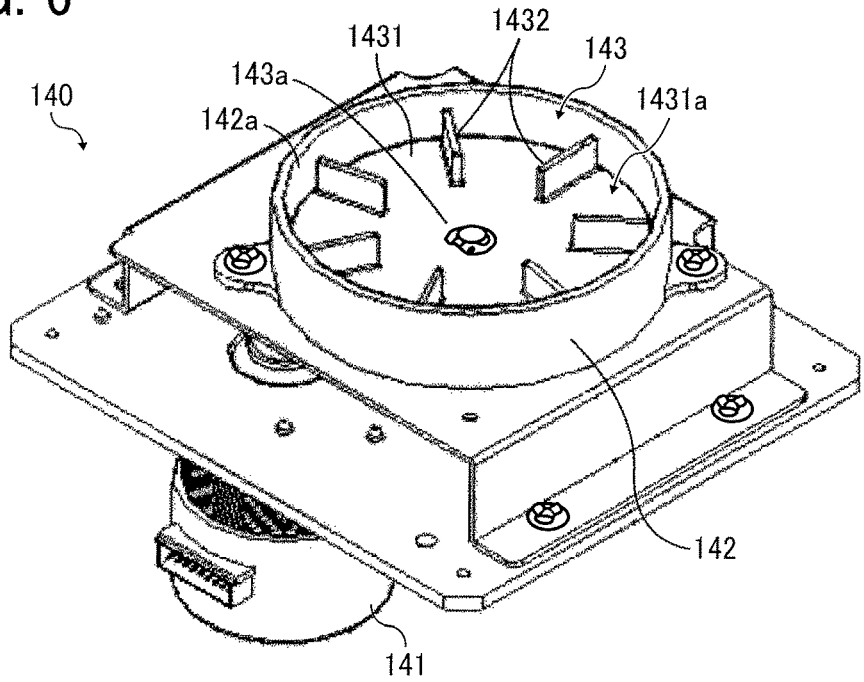
FIG. 6 is a perspective view illustrating an embodiment of a second suction unit.

The second suction unit 140 as an suction device includes a rotary fan 143, a second driver 141 that rotates the rotary fan 143, and a housing 142 that covers a circumference of the rotary fan 143. As illustrated in FIG. 6, an opening 142*a* is formed at one end of the housing 142. The rotary fan 143 includes a planar board 1431, and a plurality of rib-shaped blades 1432 as a plurality of walls disposed radially on one planar face 1431*a* of the board 1431. The second suction unit 140 is disposed such that the opening 142*a* of the rotary fan 143 is directed toward the conveyed medium 101 as a suction target as illustrated in FIG. 1. In the present embodiment, the opening 142*a* is so disposed as to face, from above, the topmost conveyed medium 101A of the conveyed media 101 disposed on the stacker 110. The second suction unit 140 generates a vortex air "bw" when the second driver 141 causes the rotary fan 143 to rotate, and attracts the conveyed medium 101A positioned in the suction target direction by a vortex air suction method or a tornado method. In the present embodiment, the second suction unit 140 includes the housing 142; however, without the housing 142 disposed on the circumference of the rotary fan 143, the vortex air "bw" can be generated. As a result, the second suction unit 140 may not include the housing 142. Alternatively, the second suction unit 140 may include a shutter device to open or close the opening 142*a* of the housing 142 and a second shutter driver to cause the shutter device to open or close, so that the shutter device can be open or closed with the rotary fan 143 kept rotating. With this structure, the timing of the vortex air "bw" to be exerted on the conveyed medium 101A can be adjusted.

Figure 7A:
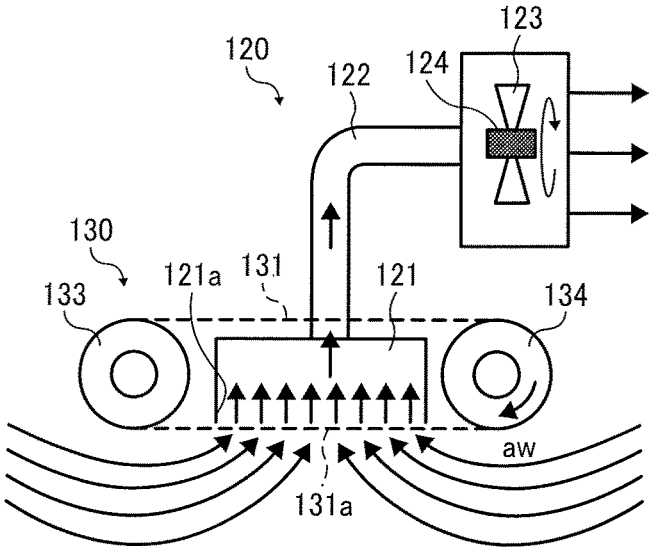
FIG. 7A schematically illustrates an airflow due to operation of the first suction unit.
Figure 7B:
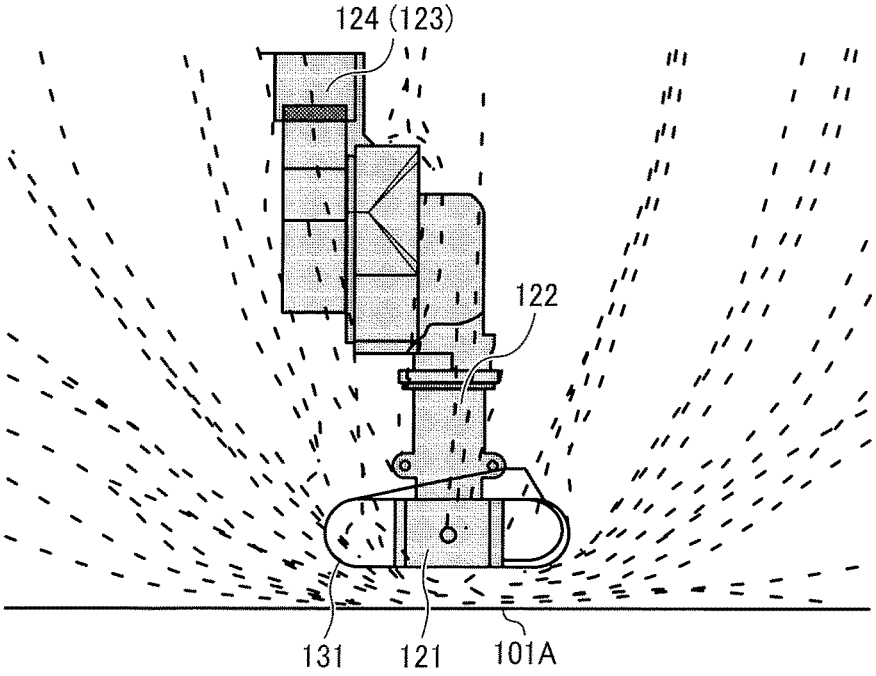
FIG. 7B illustrates a flow velocity chart showing an analysis result of the flow of air due to operation of the first suction unit.

Referring to FIGS. 7A and 7B and FIGS. 8A and 8B, the flow of air due to the first suction unit 120 and the second suction unit 140 will be described. As illustrated in FIG. 7A, when the suction fan 123 in the first suction unit 120 rotates, negative pressure is generated to the suction chamber 121 and the air below the conveyance device 130 is attracted from the multiple small-diameter holes 131*a* of the conveyor belt 131. As a result, the airflow "aw" is generated, and a suction force is exerted on the conveyed medium 101A. However, the first suction unit 120 attracts the air from the small-diameter holes 131*a* of the conveyor belt 131 of the conveyance device 130, the air around the small-diameter holes 131*a* is attracted from the whole space, the suction force exerted on the away-disposed conveyed medium 101 becomes weak. Specifically, in the suction structure employing the chamber method to generate a negative pressure within the suction chamber 121 by suctioning air from various directions, the suction force to attract the away-disposed suction target is weak. As a result, in the first suction unit 120, when the airflow "fw" blown from the fan 150 lifts the topmost conveyed medium 101A as a suction target to separate the conveyed medium 101, a distance to the conveyed medium 101A becomes shorter and the conveyed medium 101A can be attracted easily. Specifically, the first suction unit 120 can attract the suction target disposed at a relatively removed position because the airflow "fw" from the fan 150 provides a support. FIG. 7B illustrates a flow velocity chart of the airflow "aw" when a model of the first suction unit 120 is formed software-wise by a computer, and the formed model is analyzed using analysis simulation software. It is understood from the flow velocity chart that, in the first suction unit 120 employing the chamber method suction unit, the flow velocity curves are attracted widely from the whole space to the suction chamber 121.

Figure 8A:
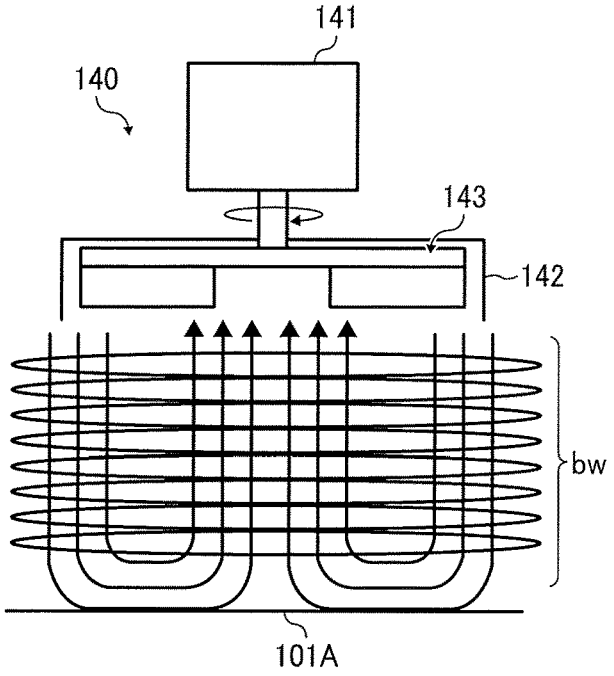
FIG. 8A schematically illustrates a vortex air being an airflow caused by operation of the second suction unit.
Figure 8B:
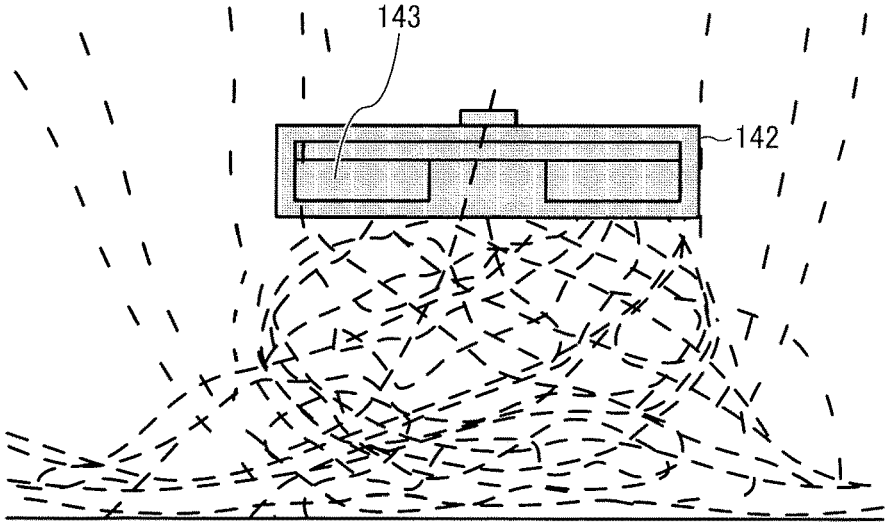
FIG. 8B illustrates a flow velocity chart showing an analysis result of the flow of air due to operation of the second suction unit.

Contrarily, as illustrated in FIG. 8A, in the second suction unit 140, the rotary fan 143 having radially mounted blades 1432 rotates, so that the vortex air "bw" is generated below the rotary fan 143. As a result, negative pressure is generated in a center portion 143*a* of the rotary fan 143 corresponding to the center portion of the vortex air "bw," and the topmost conveyed medium 101A is attracted. This vortex air "bw" is generated mainly just below the blade 1432, and so, the suction target (or the conveyed medium 101A) disposed relatively removed from the rotary fan 143, can be given a suction force. And the suction target (or the conveyed medium 101A) disposed away from the first suction unit 120 can be attracted without any support from the airflow "fw" from the fan 150. FIG. 8B is a flow velocity chart of the vortex air "bw" when the model of the second suction unit 140 is software-wise generated, and the generated model is analyzed using analysis simulation software. As illustrated in this flow velocity chart, the second suction unit 140 employing a tornado suction method shows that the flow velocity has a higher density in a space below the rotary fan 143, and the vortex air "bw" is formed and attracted.

As illustrated in FIG. 2, a side air nozzle 180 to blow side air is disposed at one of the side fences 112 and 112 in the depth. The side air blows air via the side air nozzle 180 from one side in the width direction W perpendicular to the conveyance direction to separate each medium contacting each other among the stacked conveyed media 101. The side air nozzle 180 is connected to a side blower 190 (see FIG. 9) that generates an airflow. The airflow generated by the side blower 190 is supplied via a duct.

Figure 9:
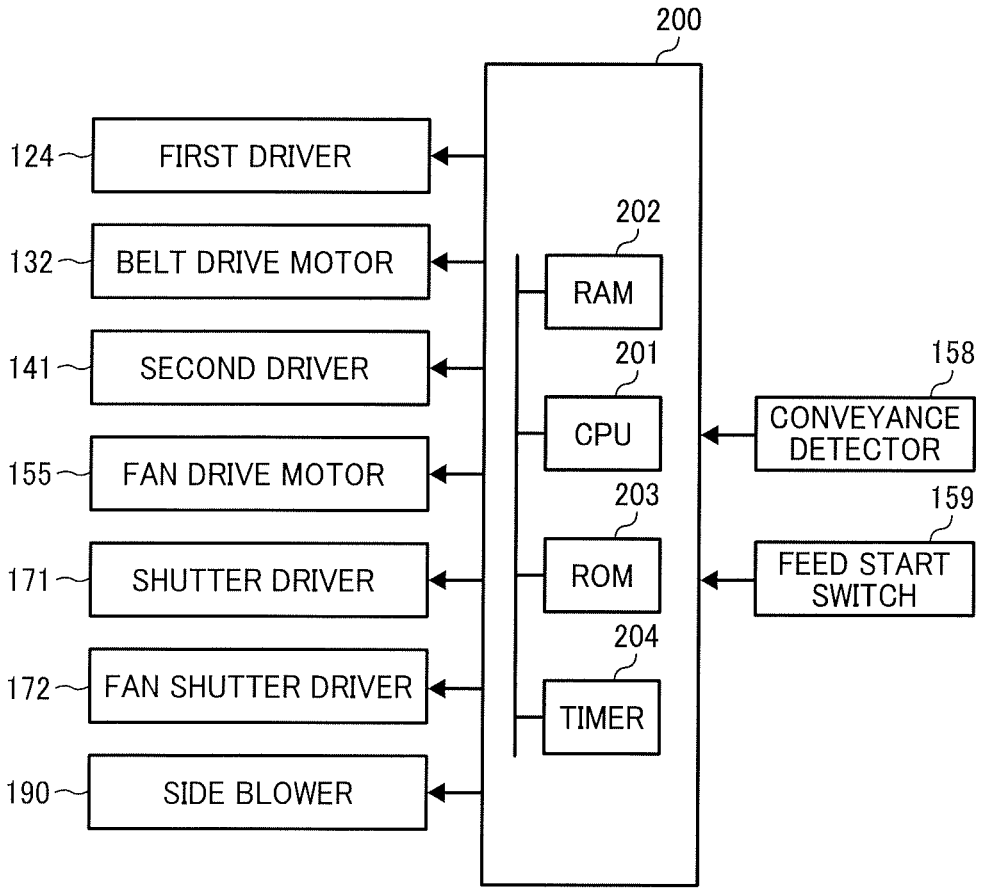
FIG. 9 is a block diagram illustrating a structure of a control system according to the first embodiment of the present disclosure.
Figure 10:
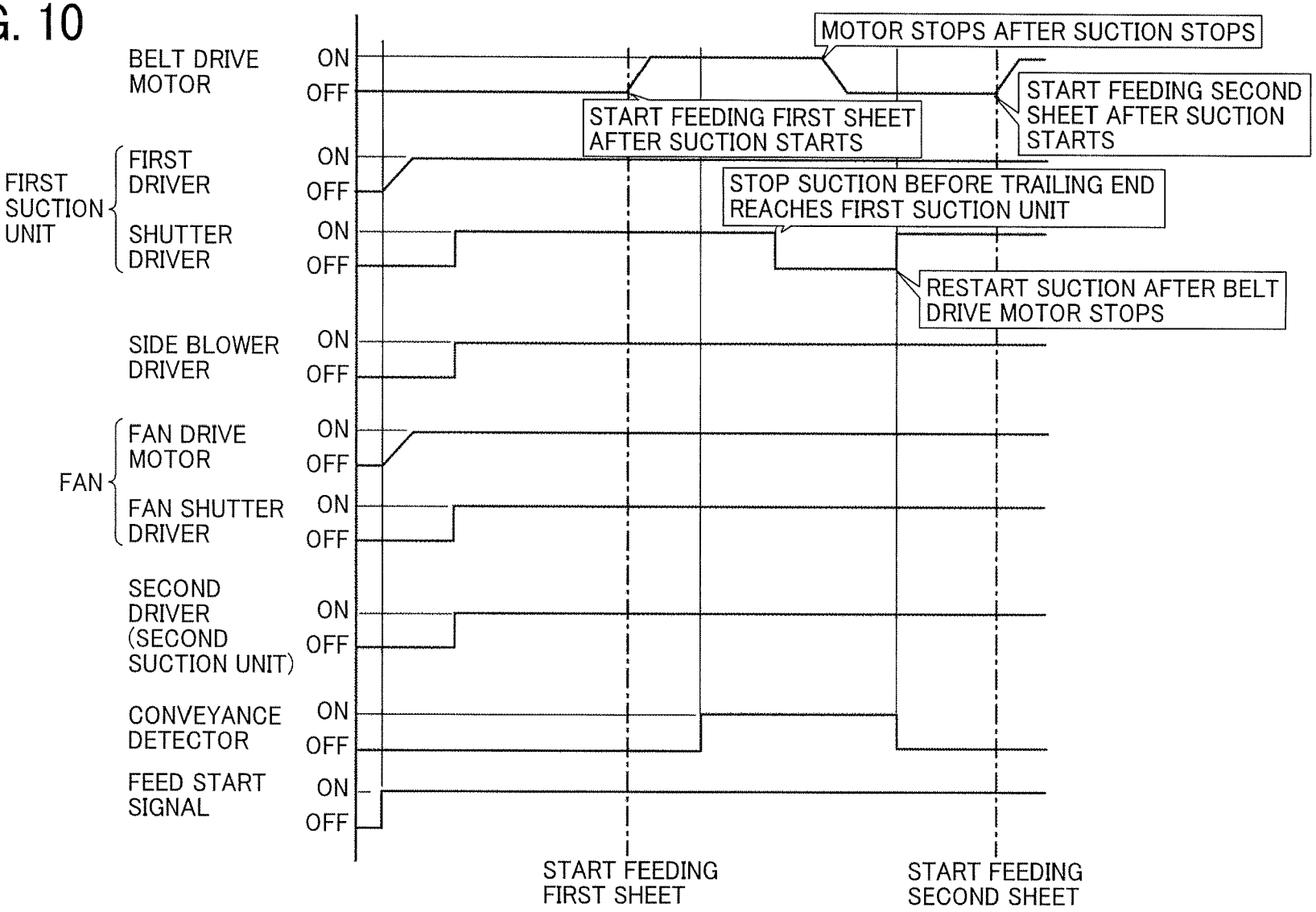
FIG. 10 is a timing chart illustrating operation of each part in the feeding device according to the first embodiment.
Figure 11:
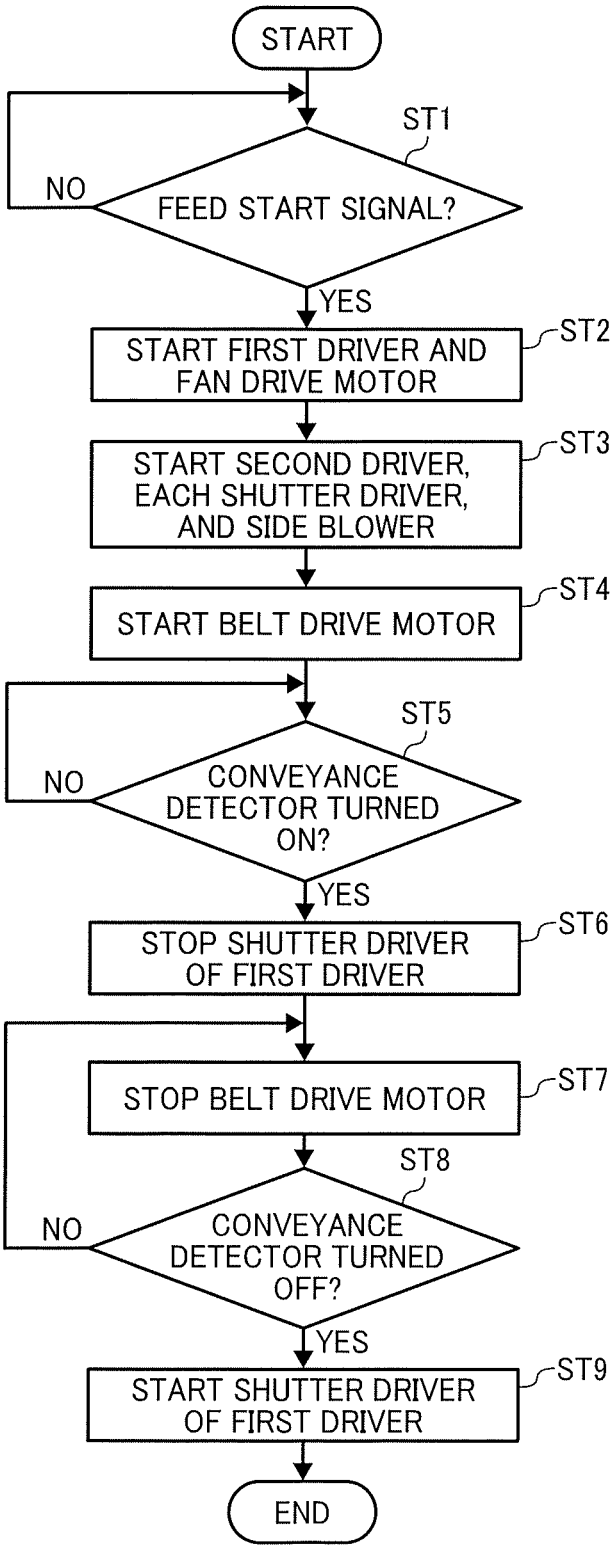
FIG. 11 is a flowchart illustrating an embodiment of the control of the feeding device according to the first embodiment.
Figure 12A:
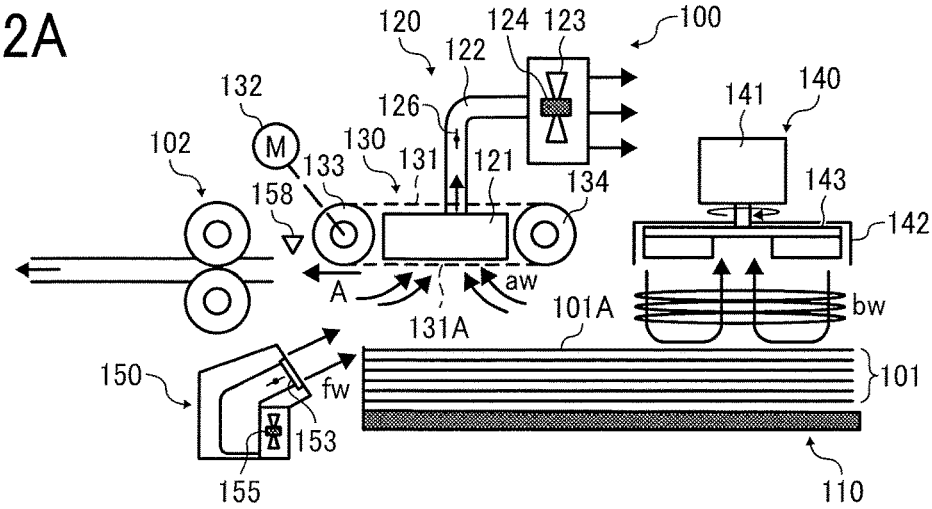
FIGS. 12A to 12C each schematically illustrate operation and process from separation to feeding of a first sheet of conveyed medium by the feeding device according to the first embodiment.
Figure 12B:
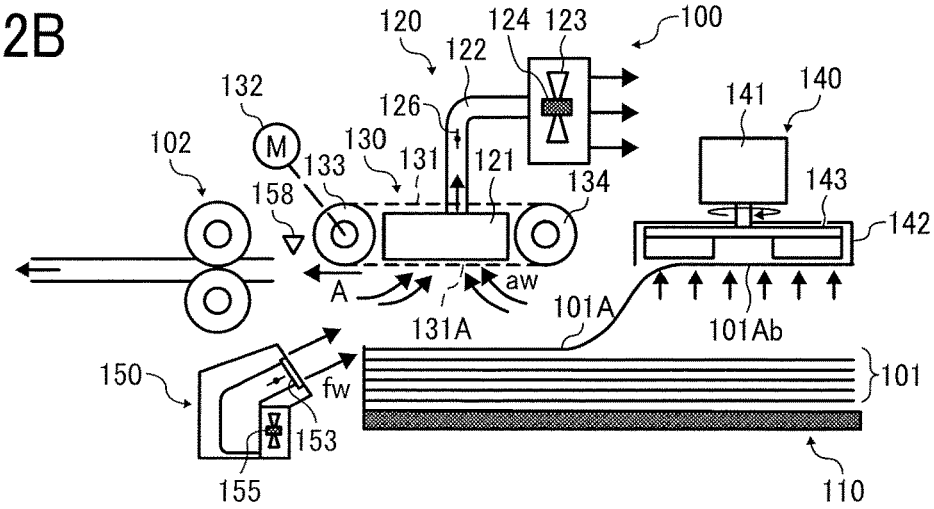
Figure 12C:
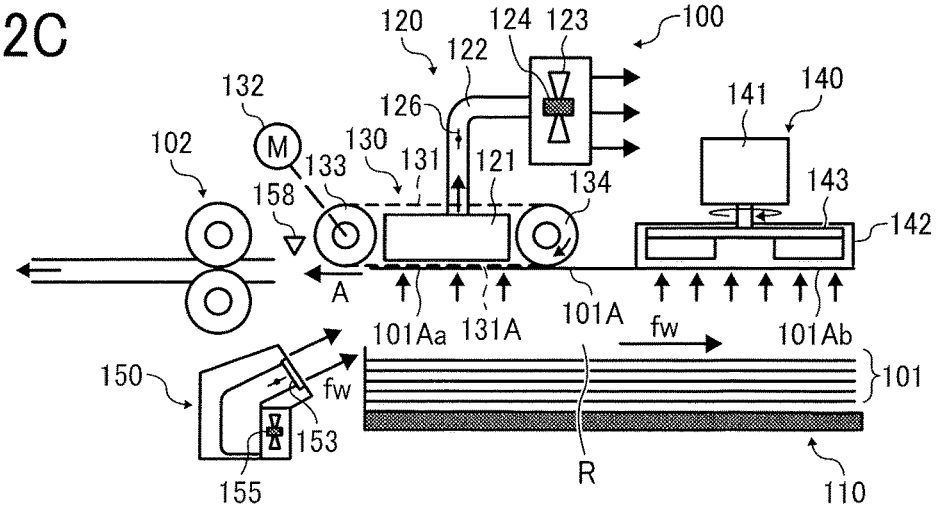
Figure 13A:
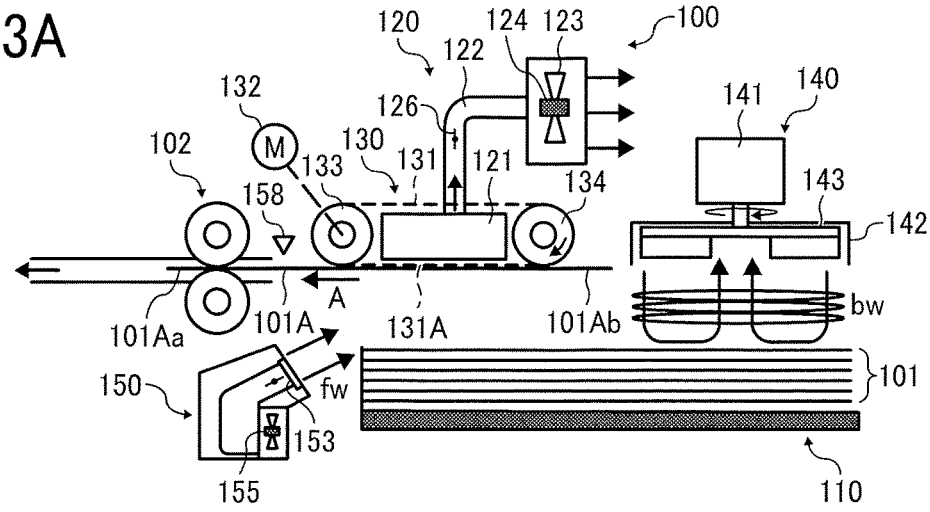
FIGS. 13A to 13C each schematically illustrate operation and process from separation to attraction of a second sheet of conveyed medium by the feeding device according to the first embodiment.
Figure 13B:
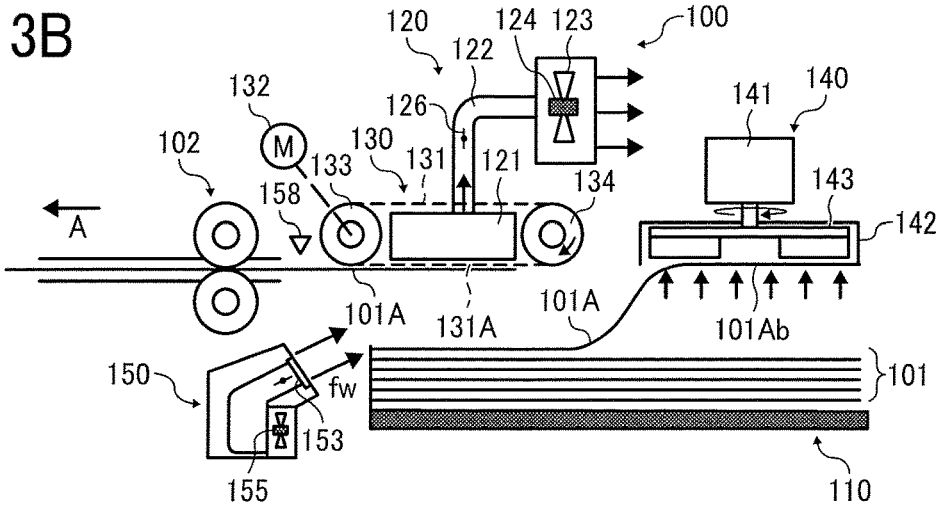
Figure 13C:
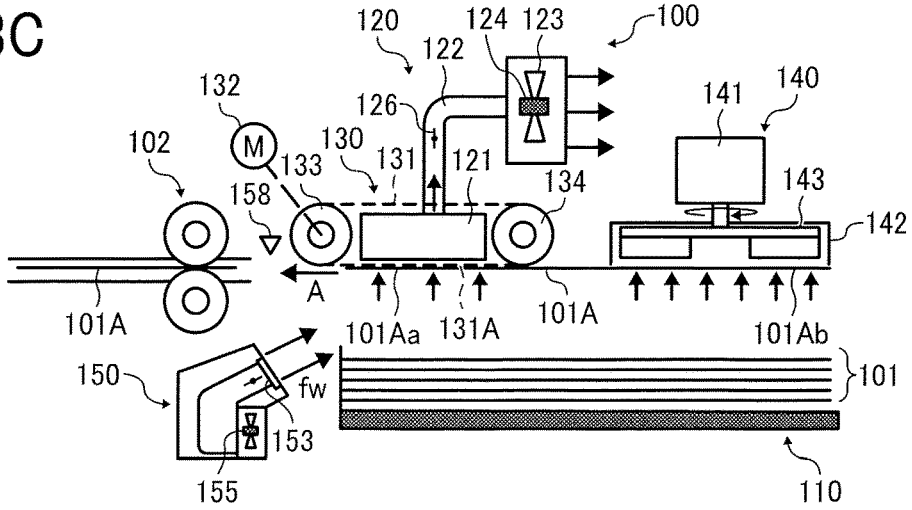

Next, a structure of the control system and operational flow of each part by a controller 200 according to the first embodiment will be described. FIG. 9 is a block diagram illustrating a functional structure of a controller 200 according to the first embodiment; and FIG. 10 illustrates an operational timing chart of each part of the feeding device 100. In FIG. 9, the controller 200 includes a computer that includes a centra processing unit (CPU) 201, a random-access memory (RAM) 202, a read-only memory (ROM) 203, and a timer 204. At an input side of the controller 200, a conveyance detector 158 to detect a state of conveyance of the conveyed medium 101 and a feed start switch 159 to input a feed start signal are connected to the controller 200 via signal lines. The conveyance detector 158 is disposed downstream of the first suction unit 120 and is formed of a sensor to optically detect the conveyed medium 101A. At an output side of the controller 200, the first driver 124, the belt drive motor 132, the second driver 141, the fan drive motor 155, the shutter driver 171 and the fan shutter driver 172, and the side blower 190 are connected to the controller 200 via signal lines. Operation of the first driver 124, the belt drive motor 132, the second driver 141, the fan drive motor 155, the shutter driver 171, the fan shutter driver 172, and the side blower 190 is controlled to be turned on and off by an operation timing stored in the ROM 203 of the controller 200. FIG. 11 illustrates a flowchart of suction and conveyance control by the controller 200 of the feeding device 100 according to the first embodiment. FIGS. 12A to 12C and FIGS. 13A to 13C illustrate operation and processes from separation to conveyance of the feeding device 100 according to the embodiment of the present disclosure. FIGS. 13A to 13C illustrate operation performed after the operation performed in FIG. 12C.

When the feed start switch 159 is operated and the feed start signal is input in Step ST1, the controller 200 operates the first driver 124 and the fan drive motor 155 in Step ST2, and the process goes to Step ST3. In Step ST3, the controller 200 operates the side blower 190, the shutter driver 171, the fan shutter driver 172, and the second driver 141. As a result, as illustrated in FIG. 12A, the airflow "fw" is blown to the leading edge 101Aa of the conveyed medium 101 from a blast nozzle 153 of the fan 150, and the side air is blown to the side end of the conveyed medium 101 from the side air nozzle 180. In addition, the airflow "aw" is generated in the first suction unit 120 and the vortex air "bw" is generated in the second suction unit 140, and a suction force is generated due to the negative pressure. In the present embodiment, as illustrated in FIG. 10, the shutter driver 171 of the first driver 124 and the second driver 141 are operated at the same time; however, the second driver 141 can be operated before the start of the shutter driver 171, and the rotary fan 143 is rotated and the air at the trailing edge 101Ab of the conveyed medium 101A can be attracted.

When the second driver 141 is activated, a stronger suction force than that of the first suction unit 120 is generated in the second suction unit 140. In addition, the second suction unit 140 is disposed upstream of the first suction unit 120 in the conveyance direction. Accordingly, the suction force of the second suction unit 140 exerts to the trailing edge 101Ab of the topmost conveyed medium 101A in the stacker 110, and the trailing edge 101Ab of the conveyed medium 101A floats and is attracted as illustrated in FIG. 12B. At the same time with the floating of the trailing edge 101Ab, as illustrated in FIG. 12C, the suction force of the first suction unit 120, the airflow "fw" blown from the fan 150 to the leading edge 101Aa, and the airflow from the side air nozzle 180 are blown. With these airflows, the leading edge 101Aa and the side of the conveyed medium 101 are floated and are attracted to the suction face 131A of the conveyor belt 131, and the topmost conveyed medium 101A is separated from the conveyed medium 101 positioned below. In this case, because the trailing edge 101Ab of the conveyed medium 101A is attracted by the second suction unit 140, an air path R through which the airflow "fw" blown from the fan 150 passes is formed between the topmost conveyed medium 101A and the conveyed medium 101 positioned below. Therefore, there is no need of waiting for arrival of the trailing edge 101Ab and the separation time can be reduced. In addition, the first conveyed medium 101A can stand by while being attracted and does not contribute to the productivity, so that the first conveyed medium 101A can be attracted by the first suction unit 120 in advance.

After the start of attraction of the conveyed medium 101, the controller 200 operates the belt drive motor 132 in Step ST4 in FIG. 11. At this timing, the topmost conveyed medium 101A (i.e., the first sheet) is started to be conveyed. As illustrated in FIGS. 12C and 13A, when the belt drive motor 132 is operated, the conveyor belt 131 rotates clockwise, the conveyed medium 101A attracted to the suction face 131A is conveyed in the conveyance direction A, and the leading edge 101Aa is conveyed to a conveyance roller pair 102 disposed downstream of the first suction unit 120. At this time, the second suction unit 140 continues to operate without stopping suction. As illustrated in FIG. 13B, when the trailing edge 101Ab of the first sheet of the conveyed medium 101A passes through the second suction unit 140 (and the conveyance detector 158 is turned on and a predetermined time has passed), and immediately after that, the trailing edge 101Ab of the second topmost conveyed medium 101A is attracted. That is, the controller 200 determines whether the conveyance detector 158 is turned on in Step ST5. Here, when the conveyance detector 158 is on, and after a predetermined time has passed, the controller 200 determines that the first conveyed medium 101A has been fed properly. Then, the process goes to ST6, and ST7.

The controller 200 stops operation of the shutter driver 171 of the first suction unit 120 in Step ST6, stops operation of the belt drive motor 132 in Step ST7, and determines whether the conveyance detector 158 is turned off or not in Step ST8. When it is determined that the conveyance detector 158 is turned off in Step ST8, the controller 200 proceeds to Step ST9. That is, during the processes from ST5 to ST8, the controller 200 detects a position of the trailing edge 101Ab of the first conveyed medium 101A; before the trailing edge 101Ab passes through the suction chamber 121 (that is, when the predetermined time has elapsed since the conveyance detector 158 turned on), the controller 200 stops operation of the shutter driver 171 of the first suction unit 120, to thereby close the shutter device 126 and stop suctioning. This is to prevent the second conveyed medium 101A from being attracted and conveyed at the same time.

The controller 200 determines whether the trailing edge 101Ab of the first conveyed medium 101A passes through the conveyance device 130 in Step ST8. When it is determined that the conveyance detector 158 is turned off, the controller 200 determines that the trailing edge 101Ab of the first conveyed medium 101A has passed the conveyance device 130, and the process moves on to Step ST9. The controller 200 operates the shutter driver 171 of the first suction unit 120 in Step ST9. As a result, as illustrated in FIG. 13C, the first suction unit 120 resumes suctioning the leading edge 101Aa of the conveyed medium 101A. By repeatedly performing the operation as described above, without causing any misfeed, the productivity can be improved more than the outstanding device.

Resumption of suctioning by the first suction unit 120 does not mean the start of operation of the first driver 124. Instead, the shutter driver 171 is driven to open the shutter device 126, and the suction force is exerted on the conveyed medium 101A. This is because, when the start and the stop of the suctioning are controlled by the operation of the first driver 124 alone, it takes time from the rotation of the suction fan 123 to the generation of the predetermined negative pressure. As a result, when the first conveyed medium 101A is to be attracted after the feed start signal input, the first driver 124 is operated and the suction force is exerted on the conveyed medium 101A; however, after the operation of the first driver 124 has already been started, the stop and restart of the suction force are preferably made by opening or closing the shutter device 126.

Figure 27A:
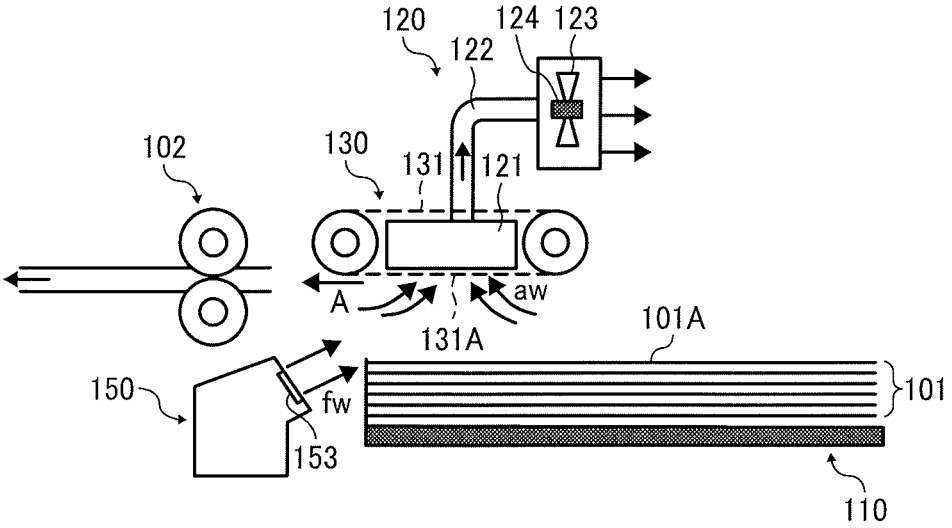
FIG. 27A BACKGROUND ART
FIGS. 27A to 27D schematically illustrate operation and process from separation to conveyance of the feeding device including one suction unit from separation to conveyance according to the background art.
Figure 27B:
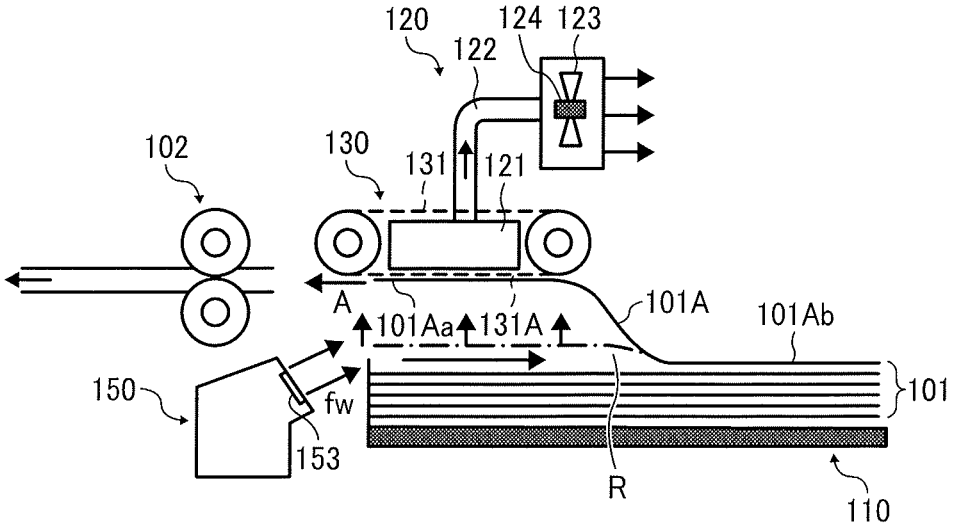
FIG. 27B BACKGROUND ART
Figure 27C:
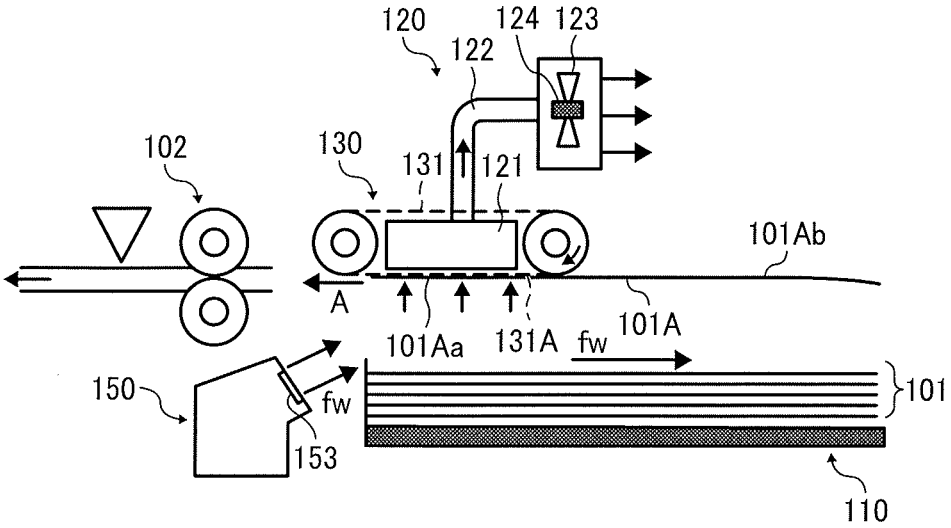
FIG. 27C BACKGROUND ART
Figure 27D:
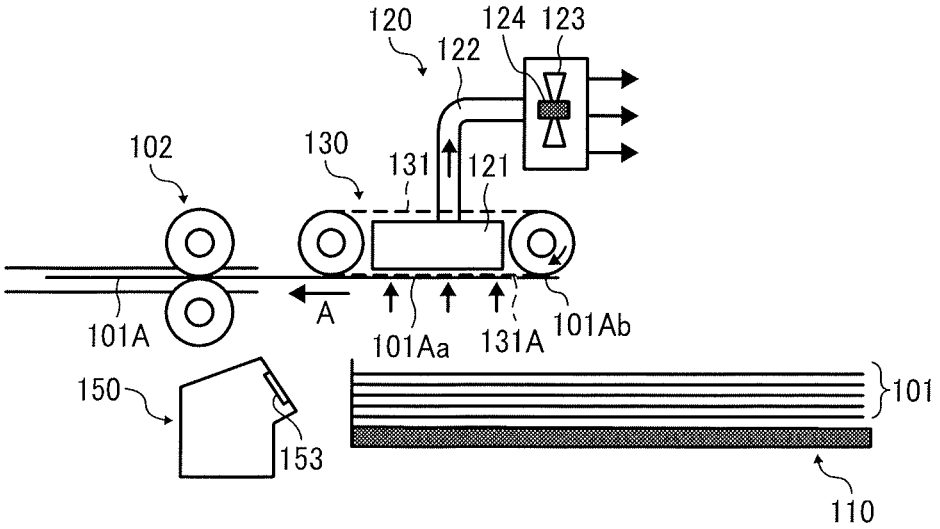
FIG. 27D BACKGROUND ART
Figure 28A:
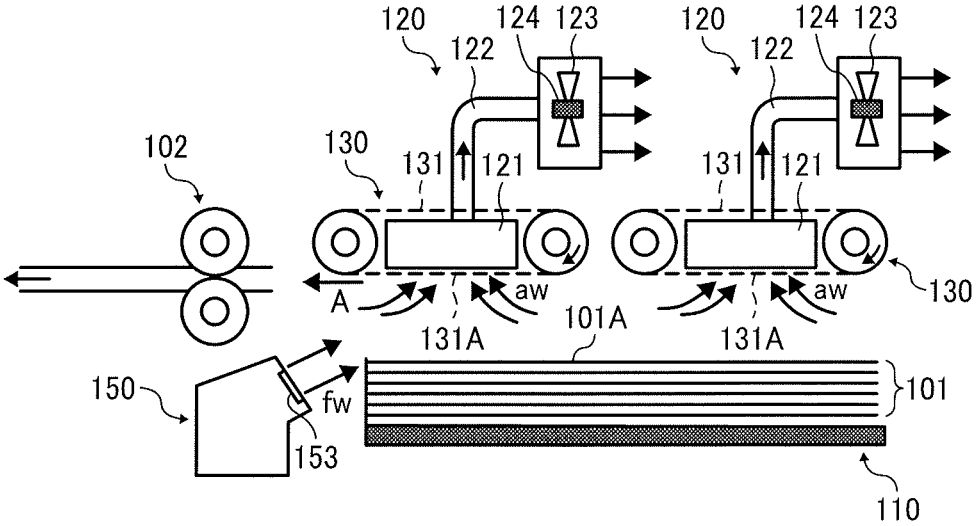
FIG. 28A BACKGROUND ART
FIGS. 28A to 28D schematically illustrate operation and process from separation to conveyance of the feeding device including a plurality of suction units according to the background art.
Figure 28B:
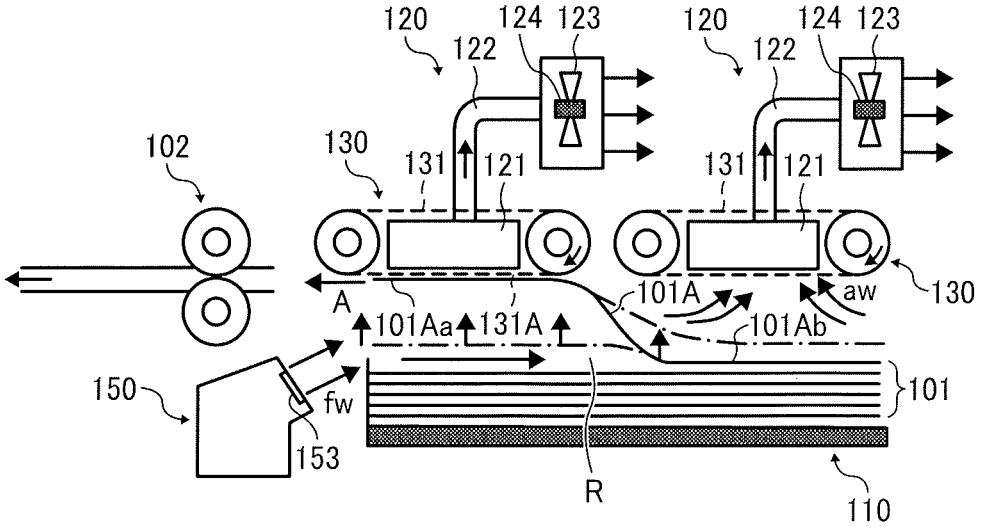
FIG. 28B BACKGROUND ART
Figure 28C:
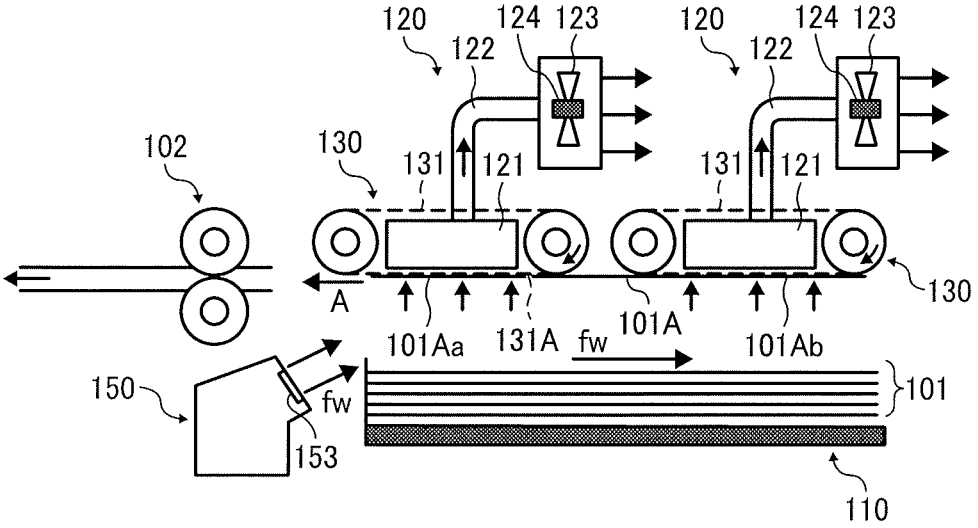
FIG. 28C BACKGROUND ART
Figure 28D:
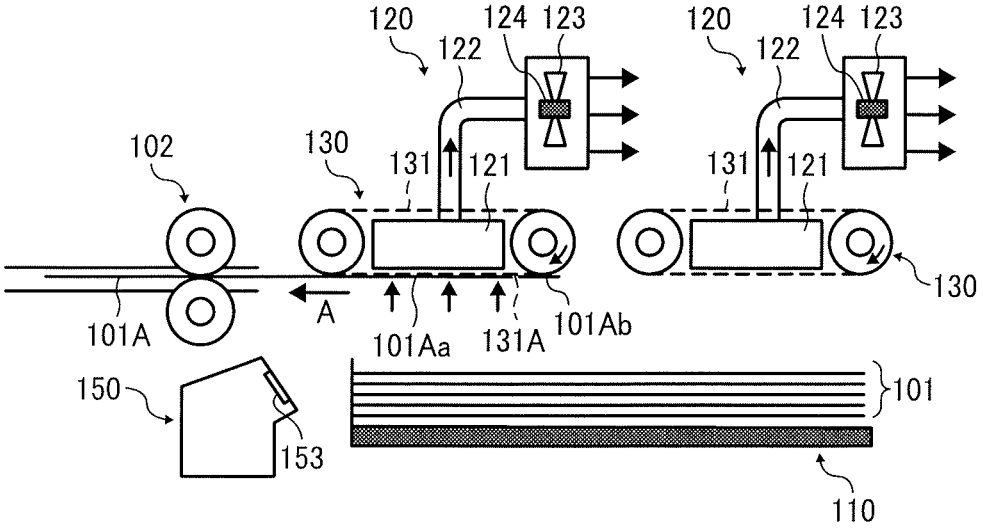
FIG. 28D BACKGROUND ART

FIGS. 27A to 27D illustrates one of the background art structures including the first suction unit 120, the conveyance device 130, and the fan 150, in which the first suction unit 120 and the conveyance device 130 are disposed above the leading edge 101Aa of the conveyed medium 101, and the conveyed medium 101 is separated from the following conveyed medium 101. In this structure, as illustrated in FIGS. 27A and 27B, the fan 150 blows the airflow "fw" for separation and the first suction unit 120 generates airflow "aw" to exert a suction force to the leading edge 101Aa of the conveyed medium 101A. As a result, if the conveyance device 130 is operated before the airflow "fw" reaches the trailing edge 101Ab of the conveyed medium 101A and the separation is fully complete, the following conveyed medium 101 tends to be moved by following the move of the conveyed medium 101A conveyed by the conveyance device 130. Accordingly, to prevent following movement, as illustrated in FIG. 27C, the conveyance device 130 may not be operated unti the airflow "fw" reaches the trailing edge 101Ab of the conveyed medium 101A and the separation completely ends. As illustrated in FIG. 27D, the conveyed medium 101A is not fed and there remained an issue to be improved concerning the productivity. When comparing the structure as described above and the structure according to the first embodiment of the present disclosure, because the second suction unit 140 having a stronger suction force, attract in advance the trailing edge 101Ab of the conveyed medium 101A, the air path R is formed. Then, before the airflow "fw" reaches the trailing edge 101Ab of the conveyed medium 101A, separation of the trailing edge 101Ab has been finished. Then, the conveyance device 130 can be operated earlier, and the separation time can be reduced while improving the suction performance and productivity.

As illustrated in FIGS. 28A to 28D, a background art structure includes suction devices disposed at the leading edge and the trailing edge of the conveyed medium to attract the conveyed medium. These suction devices employ the chamber suction device that corresponds to the first suction unit 120, and suctioning of the conveyed medium 101A from an away position is difficult, and it is difficult to float the trailing edge 101Ab of the conveyed medium 101A earlier than the leading edge 101Aa. By contrast, the feeding device 100 according to the first embodiment includes the second suction unit 140 that is disposed near to the trailing edge 101Ab of the conveyed medium 101 and employs the tornado method suction unit. Accordingly, the trailing edge 101Ab of the conveyed medium 101A can be attracted from the away position, the time required for separation can be reduced while improving the attracting property, the following conveyance due to the lack of separation can be prevented, and the productivity can be improved.

Second Embodiment

Figure 14:
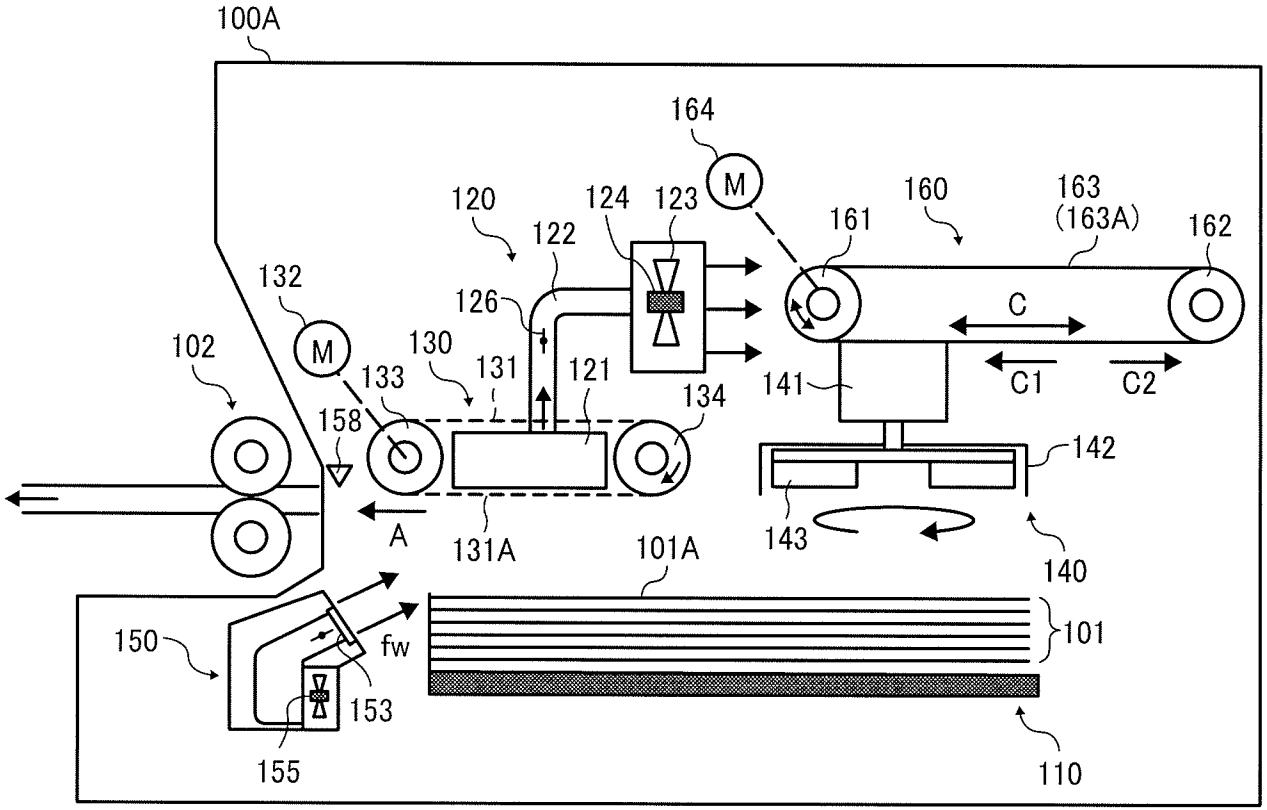
FIG. 14 schematically illustrate a structure of the feeding device according to a second embodiment of the present disclosure.

FIG. 14 illustrates a structure of the second embodiment of the present disclosure. The feeding device 100A according to the second embodiment includes a moving device 160 that retains the second suction unit 140 to be movable in parallel with the conveyed medium conveyance direction A. Otherwise, the feeding device 100A according to the second embodiment is configured similarly to the feeding device 100 according to the first embodiment. The moving device 160 includes a conveyor belt 163 stretched and supported by at least two rollers 161 and 162, and a conveyor belt drive motor 164 serving as a drive source to rotatably drive any one of the rollers 161 and 162. The second suction unit 140 is mounted on a conveyance face 163A of the conveyor belt 163 wound around the rollers 161 and 162. The moving device 160 is configured such that the conveyor belt 163 moves in parallel with the conveyance direction A, and the second suction unit 140 moves in an approaching and separating direction C relative to the first suction unit 120. The conveyor belt drive motor 164 is movable both in the normal direction and reverse direction.

When the moving device 160 drives the belt drive motor 164 in the normal direction, for example, the conveyor belt 163 rotates clockwise. When the moving device 160 drives the belt drive motor 164 in the reverse direction, the conveyor belt 163 rotates counterclockwise. As a result, the second suction unit 140 mounted to an inside of the conveyance face 163A moves in the approaching direction approaching the first suction unit 120 as indicated by Arrow C1 when the belt drive motor 164 rotates in the normal direction, and moves in the separating direction separating from the first suction unit 120 indicated by Arrow C2 when the belt drive motor 164 rotates in the reverse direction. Thus, because the second suction unit 140 is movable, the range where the suction force of the second suction unit 140 exerts is made variable in the approaching and separating direction C. Specifically, because the range where the suction force exerts to the conveyed medium 101A and the trailing edge 101Ab of the conveyed medium 101A is made variable, an optimal separation can be obtained corresponding to various sizes of the conveyed medium 101.

Figure 15:
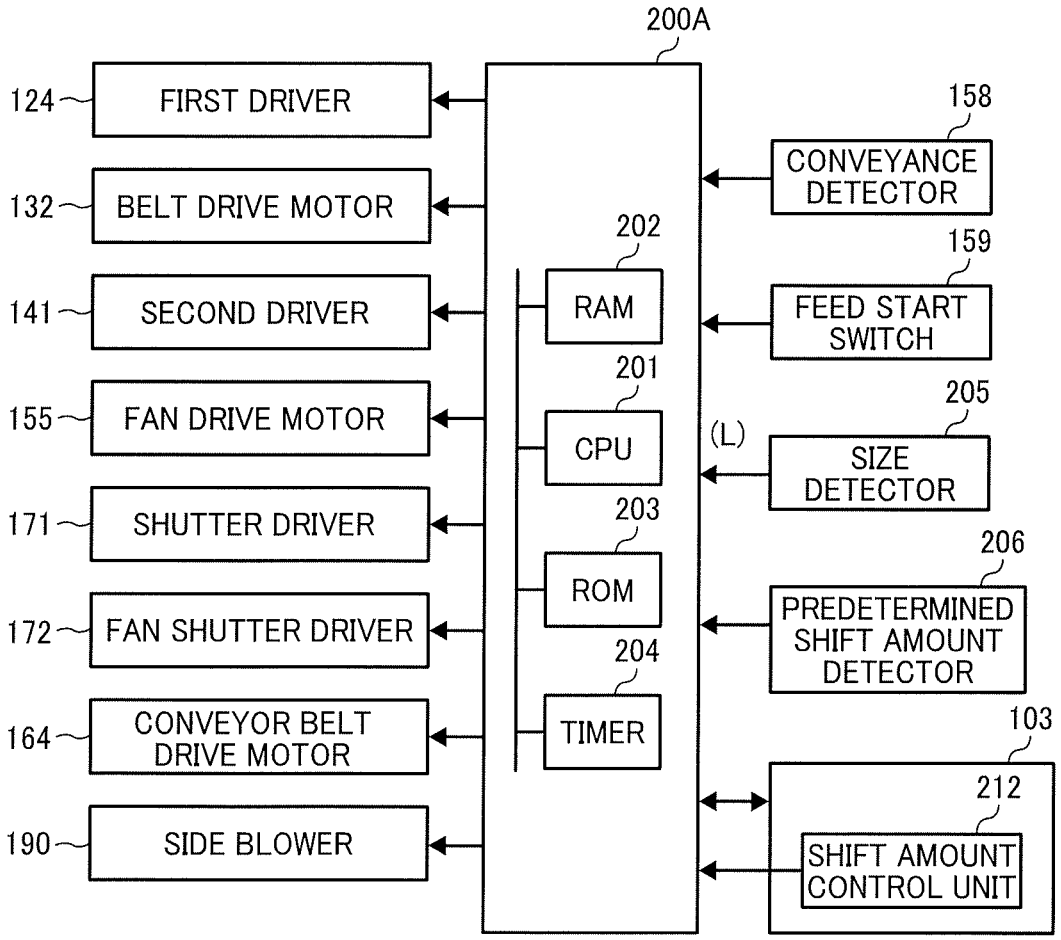
FIG. 15 is a block diagram illustrating a structure of the control system according to the second embodiment.
Figure 16:
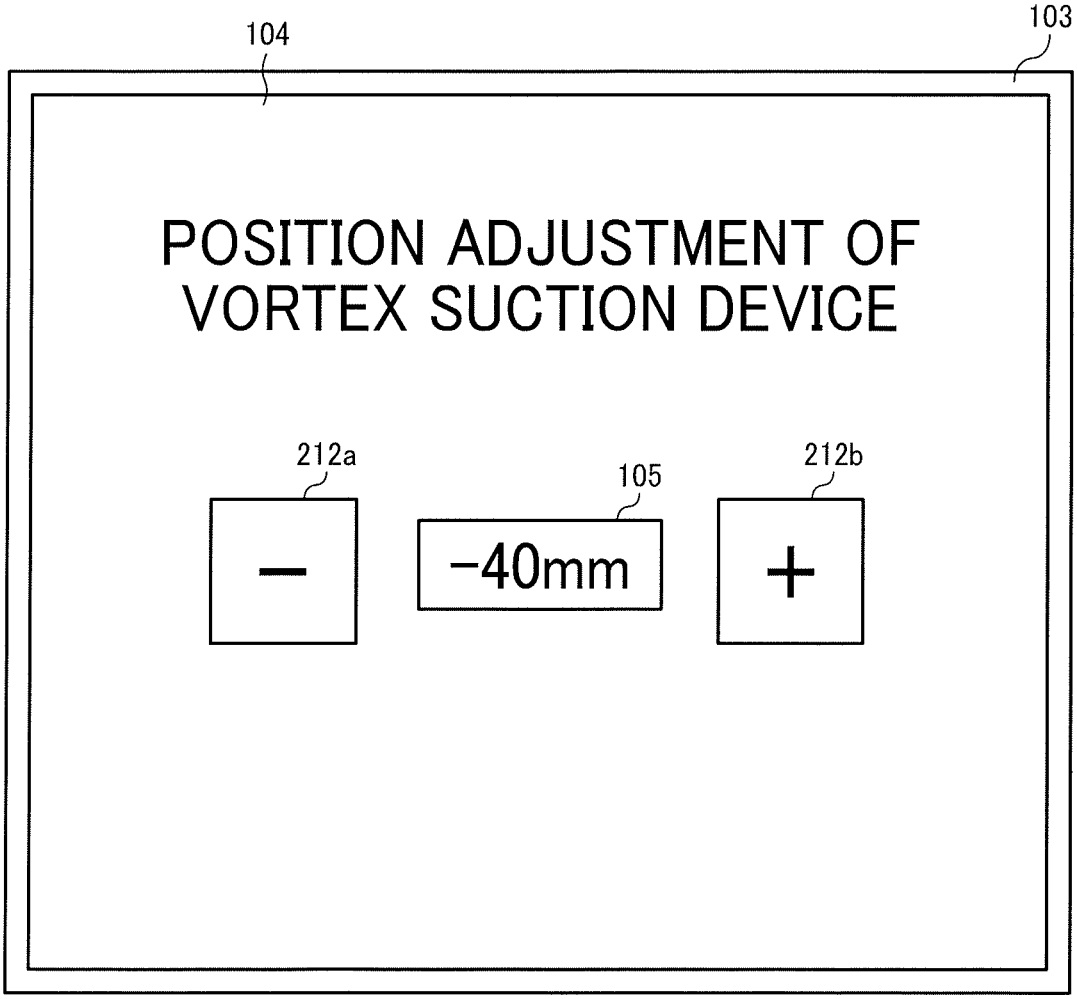
FIG. 16 is an enlarged view illustrating an embodiment of a shift amount contro unit.

Next, operation of the feeding device 100A will be described in detail, including positional control of the moving device 160. FIG. 15 is a block diagram illustrating a structure of the control system performed by a controller 200A according to the second embodiment. The feeding device 100A includes the controller 200A. The controller 200A includes a computer that includes the CPU 201, the RAM 202, the ROM 203, and the timer 204. At an input side of the controller 200A, the conveyance detector 158, the feed start switch 159, and a size detector 205 to detect size information L of the conveyed medium 101 are connected to the controller 200 via signal lines. The size information L of the conveyed medium 101 means the information related to a length in the conveyance direction A (that is, in the approaching and separating direction C), and the entire length of the conveyed medium 101. The size detector 205 may be of a type to detect a distance between the side fences 112 and 112 of the stacker 110, or the position of the contact member 113. Otherwise, the size detector 205 may optically detect the trailing edge of the conveyed medium 101. A predetermined shift amount detector 206 detects, for example, a moving distance of the conveyor belt 163, and otherwise, may be a rotary encoder to detect a predetermined shift amount T1 from a rotation angle of the conveyor belt drive motor 164. As illustrated in FIG. 16, a shift amount control unit 212 is used to manually set a shift amount of the second suction unit 140 by the moving device 160. In the present embodiment, the shift amount control unit 212 includes switches 212*a* and 212*b* displayed on a window 104 of a touch-panel display 103 mounted on the feeding device 100A. The switch 212*b* is used to increase the shift amount T and the switch 212*a* is used to reduce the shift amount T. On the window 104, numeral information 105 of the shift amount T set in the shift amount control unit 212 is displayed. The display 103 is connected to the controller 200 via signal lines.

At an output side of the controller 200A, the first driver 124, the belt drive motor 132, the second driver 141, the fan drive motor 155, the conveyor belt drive motor 164, the shutter driver 171, the fan shutter driver 172, and the side blower 190 are connected to the controller 200A via signal lines.

Figure 17:
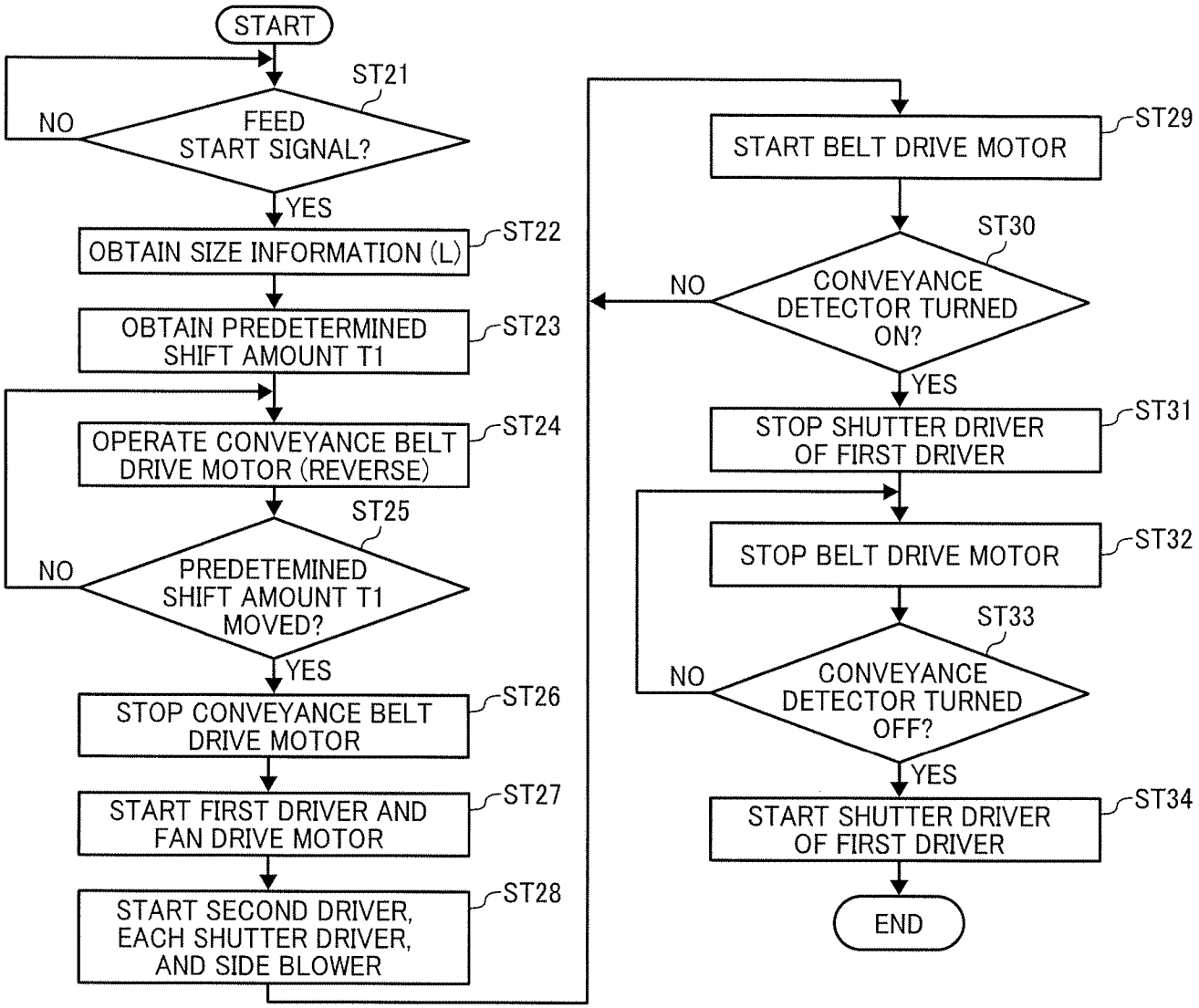
FIG. 17 is a flowchart illustrating an embodiment of controlling the feeding device according to the second embodiment.
Figure 18A:
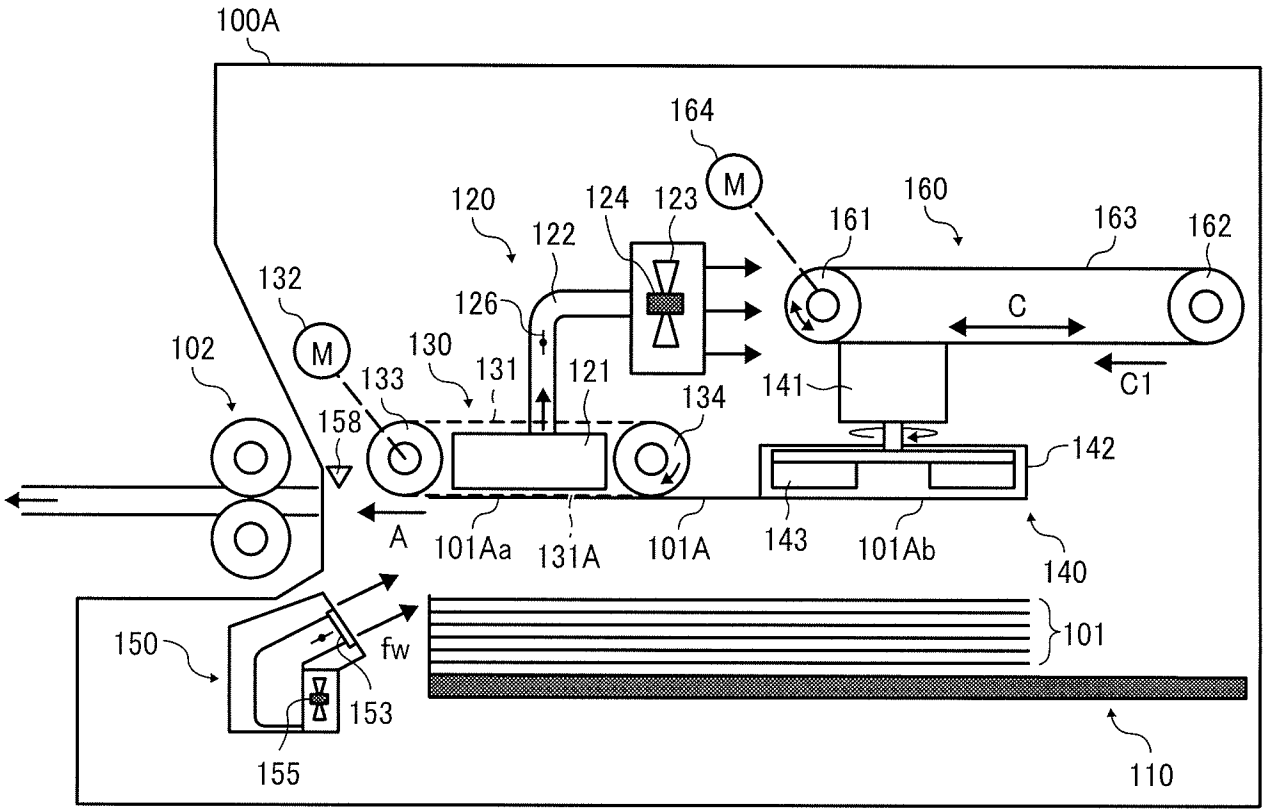
FIGS. 18A and 18B each illustrate a moving state of the second suction unit by a moving device according to the size information.
Figure 18B:
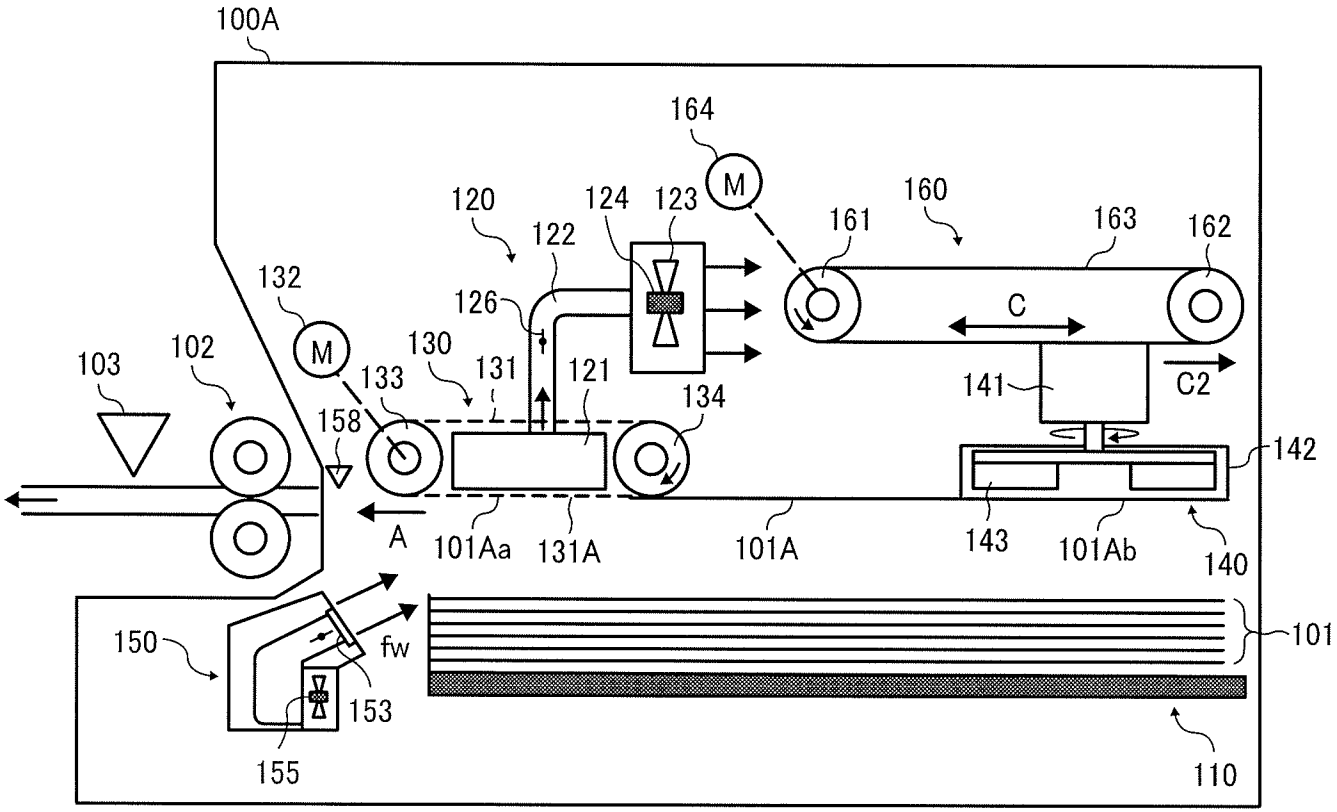
Figure 19A:
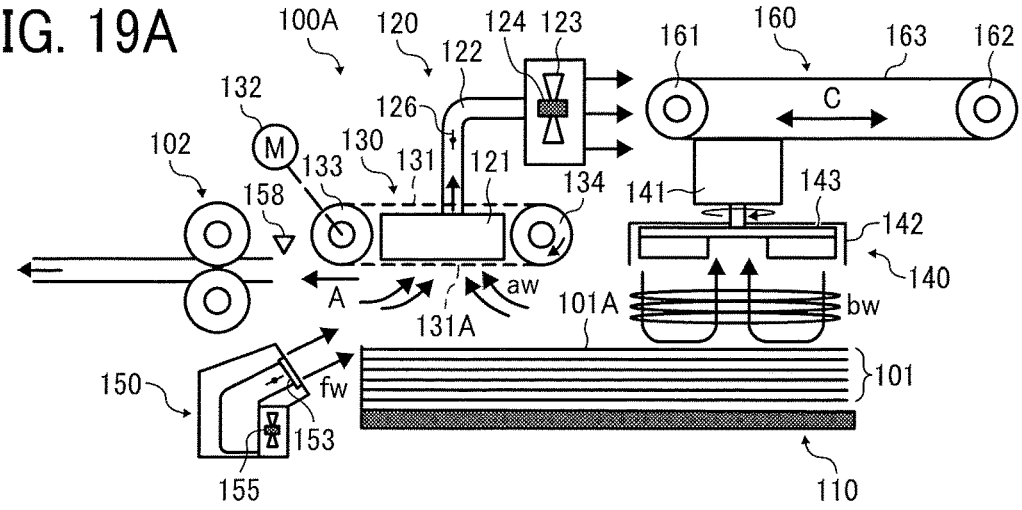
FIGS. 19A to 19C each schematically illustrate operation and process of the feeding device from separation to conveyance of a first sheet of conveyed medium according to the second embodiment.
Figure 19B:
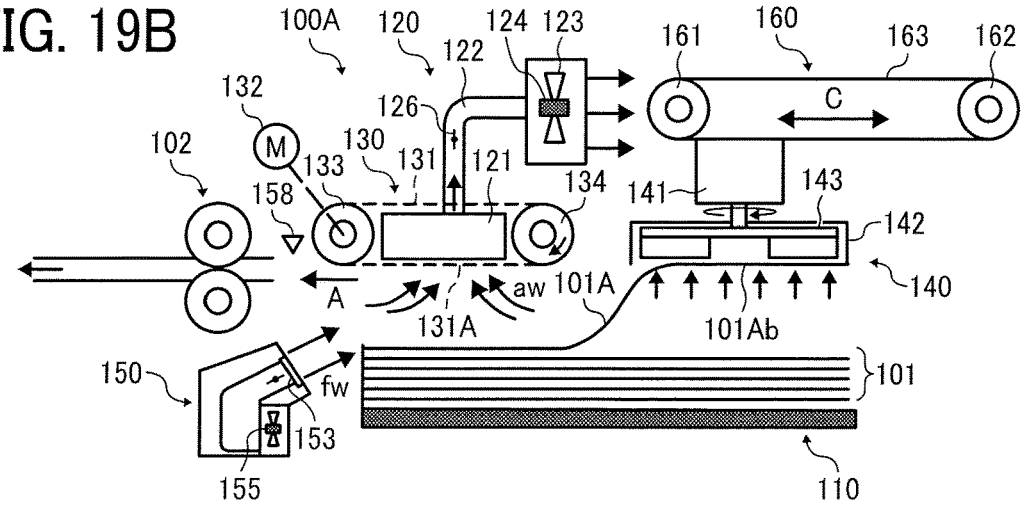
Figure 19C:
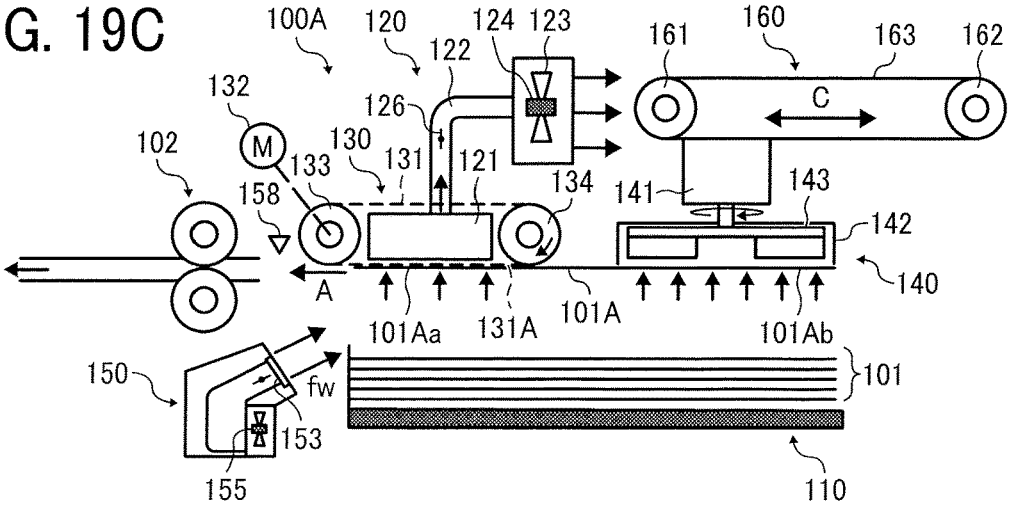

FIG. 17 is a flowchart illustrating suction and conveyance control by the controller 200A of the feeding device 100A according to the second embodiment. FIGS. 18A to 18C and FIGS. 19A to 19C represent operation and processes from separation to feeding performed by the feeding device 100A according to the present embodiment. The operation performed in FIGS. 19A to 19C represents the operation performed following the operation performed in FIG. 18C. In the present embodiment, a position of the second suction unit 140 mounted to the moving device 160, positioned nearest to the first suction unit 120 is an initial position. In addition, this initial position is the position in which the trailing edge of the minimum-sized conveyed medium 101 (that is, the trailing edge 101Ab of the topmost conveyed medium 101) feedable by the feeding device 100A can be attracted. With this initial position set as a reference, a distance that the second suction unit 140 moves to take a predetermined position corresponding to the size information L is set as a predetermined shift amount T1. In the present embodiment, the size information L and the predetermined shift amount T1 corresponding to the size information L are previously stored in the ROM 203 as a data table. In the present embodiment, as the size information L increases, the predetermined shift amount T1 is set to increase. The predetermined position means a position within the range where the suction force exerts to the trailing edge 101Ab of the conveyed medium 101A. The predetermined shift amount T1 can be computed in the CPU 201 in accordance with the size information L. In this case, the CPU 201 functions as a computing part to compute the predetermined shift amount T1.

In the present embodiment, after the position of the second suction unit 140 is adjusted, separation and conveyance of the conveyed medium 101A is performed. When the feed start switch 159 is operated and the feed start signal is input in Step ST21 in FIG. 17, the controller 200A obtains the size information L of the conveyed medium 101 in Step ST22, reads out the predetermined shift amount T1 corresponding to the size information L from the data table and obtains the data in Step ST23. Further, the controller 200A drives the conveyor belt drive motor 164 in Step ST24, and determines whether or not the moving device 160 moves by a predetermined shift amount T1 in Step ST25. The controller 200A operates the conveyor belt drive motor 164 and when the controller 200A determines that the predetermined shift amount detector 206 detects that the moving device 160 has moved by the predetermined shift amount T1, the controller 200A stops operation of the conveyor belt drive motor 164 in Step ST26. For example, when the size information L of the conveyed medium 101 detected by the size detector 205 is the minimum size, the controller 200A drives the conveyor belt drive motor 164 in the normal direction and moves the second suction unit 140 in the approaching direction C1 as illustrated in FIG. 18A to take the initial position or the nearest position. When the size information L of the conveyed medium 101 detected by the size detector 205 is the maximum size, the controller 200A drives the conveyor belt drive motor 164 in the reverse direction and moves the second suction unit 140 in the separating direction C2 as illustrated in FIG. 18B to take a separated position. In the present embodiment, the description is based on a case in which the minimum-sized conveyed medium 101 (or 101A) is conveyed.

The controller 200A operates the first driver 124 and the fan drive motor 155 in Step ST27, and the process moves on to Step ST28. In Step ST28, the controller 200A operates the side blower 190, the shutter driver 171, the fan shutter driver 172, and the second driver 141. Then, as illustrated in FIG. 19A, the airflow "fw" is blown from the blast nozzle 153 of the fan 150 to the leading edge 101Aa of the conveyed medium 101, and the side air is blown from the side air nozzle 180 to the side end of the conveyed medium 101. The first suction unit 120 generates the airflow "aw" and the second suction unit 140 generates the vortex air "bw", and suction force due to the negative pressure is generated in each suction unit.

When the second driver 141 operates, a suction force stronger than that of the first suction unit 120 is generated in the second suction unit 140. In addition, the second suction unit 140 is disposed upstream of the first suction unit 120 in the conveyance direction. As a result, the suction force of the second suction unit 140 exerts to the trailing edge 101Ab of the topmost conveyed medium 101A in the stacker 110. As illustrated in FIG. 19B, the trailing edge 101Ab of the conveyed medium 101A floats and is attracted. In addition to the floating of the trailing edge 101Ab, as illustrated in FIG. 19C, the conveyed medium 101A receives the suction force of the first suction unit 120, the airflow "fw" blown from the fan 150 to the leading edge 101Aa, and the airflow from the side air nozzle 180. Due to these airflows, the leading edge 101Aa and the side of the conveyed medium 101 float and are attracted by the suction face 131A of the conveyor belt 131, and the topmost conveyed medium 101A is separated from the conveyed medium 101 positioned below. In this case, because the trailing edge 101Ab of the conveyed medium 101A is attracted by the second suction unit 140, an air path R through which the airflow "fw" blown from the fan 150 is formed between the topmost conveyed medium 101A and the conveyed medium 101 positioned below. As a result, there is no need of waiting for arrival of the trailing edge 101Ab and the separation time can be reduced. In addition, the first conveyed medium 101A can stand by while being attracted to the conveyor belt 131 and does not contribute to the productivity, so that the first sheet of conveyed medium 101A can be attracted by the first suction unit 120 in advance.

Figure 20A:
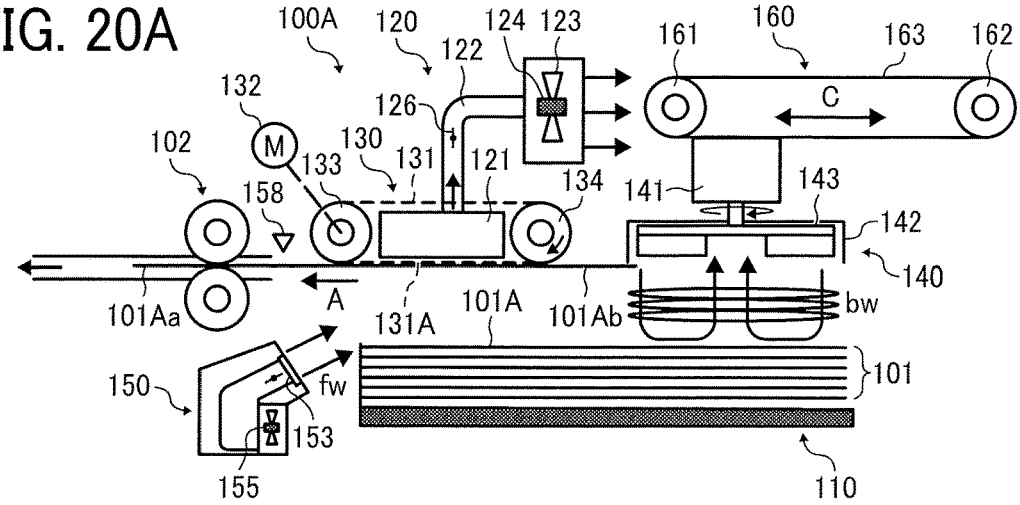
FIGS. 20A to 20C each schematically illustrate operation and process of the feeding device from separation to attraction of a second sheet of conveyed medium according to the second embodiment.
Figure 20B:
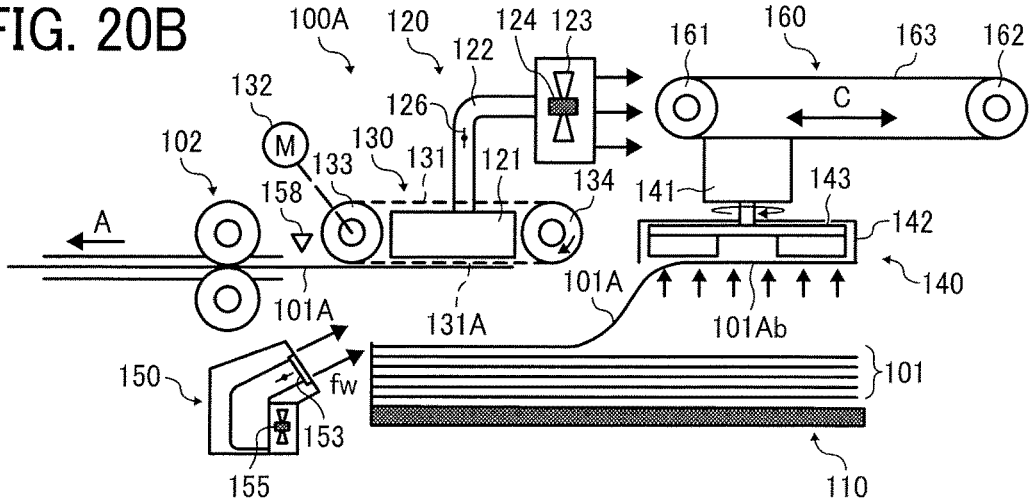

After the start of aspiration of the conveyed medium 101, the controller 200A operates the belt drive motor 132 in Step ST29. This timing is the time when the topmost conveyed medium 101A (first sheet) starts feeding. As illustrated in FIGS. 19C and 20A, when the belt drive motor 132 is operated, the conveyor belt 131 rotates to move clockwise, the conveyed medium 101A attracted to the suction face 131A is conveyed in the conveyance direction A, and the leading edge 101Aa is received by the conveyance roller pair 102 disposed downstream of the first suction unit 120 in the conveyance direction. In this case, the second suction unit 140 does not stop operation and continues operation. As illustrated in FIG. 20B, the trailing edge 101Ab of the first conveyed medium 101A passes through the second suction unit (that is, a predetermined time has elapsed after the conveyance detector 158 turned on), and immediately after that, the trailing edge 101Ab of the second topmost conveyed medium 101A is attracted. Specifically, the controller 200A determines whether the conveyance detector 158 is turned on or not, in Step ST30. Herein, when the conveyance detector 158 is turned on, after a predetermined time has passed, it is determined that the first conveyed medium 101A is normally conveyed, and the process moves on to Steps ST31 and ST32. The controller 200A stops operation of the shutter driver 171 of the first suction unit 120 in Step ST31, stops operation of the belt drive motor 132 in Step ST32, and determines whether the conveyance detector 158 is turned on or off in Step ST33. When the conveyance detector 158 is turned off in Step ST33, the process of the controller 200A moves on to Step ST34. Specifically, during processes from Step ST30 to ST34, the controller 200A detects the position of the trailing edge 101Ab of the first conveyed medium 101A, stops operation of the shutter driver 171 of the first suction unit 120 to thereby close the shutter device 126 and stops suctioning, before the trailing edge 101Ab passes through the suction chamber 121 or when the predetermined time has passed since the conveyance detector 158 turned on. This is to prevent the second conveyed medium 101A from being attracted and conveyed at the same time.

Figure 20C:
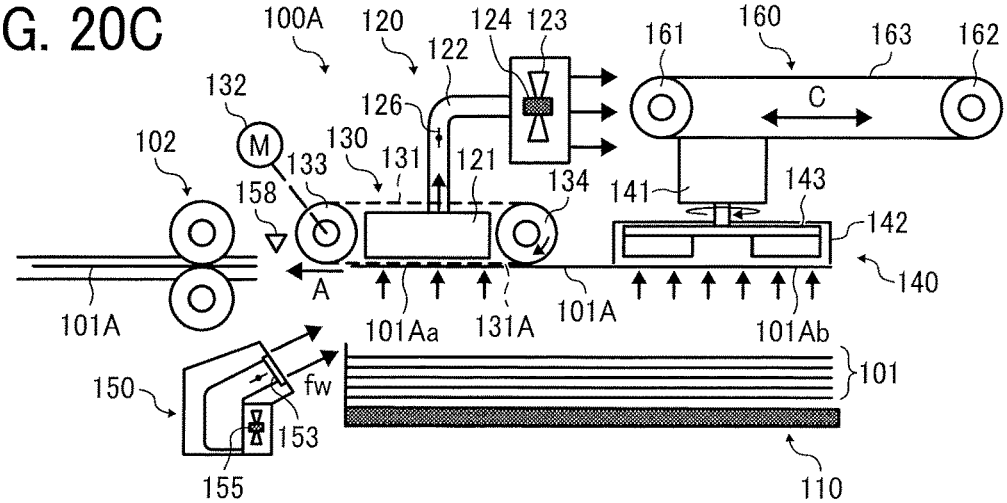

In addition, the controller 200A determines whether the trailing edge 101Ab of the first conveyed medium 101A has passed through the conveyance device 130 in Step ST33. When the conveyance detector 158 is turned off, the controller 200A determines that the trailing edge 101Ab of the first conveyed medium 101A has passed through the conveyance device 130, and the process moves on to Step ST34. In Step ST34, the controller 200A operates the shutter driver 171 of the first suction unit 120. As a result, as illustrated in FIG. 20C, the first suction unit 120 resumes attraction of the leading edge 101Aa of the conveyed medium 101A.

By repeatedly performing the operation as described above, without causing any misfeed, the productivity can be improved more than the outstanding device. Resumption of suctioning by the first suction unit 120 does not mean the start of operation of the first driver 124. Instead, the shutter driver 171 is driven to open the shutter device 126, and the suction force is exerted on the conveyed medium 101A. This is because, when the start and the stop of the suctioning are all controlled by the operation of the first driver 124, it takes time from the rotation of the suction fan 123 to the generation of the predetermined negative pressure. As a result, when the first conveyed medium 101A is to be attracted after the print signa input, the first driver 124 is operated and the suction force is exerted on the conveyed medium 101A; however, after the operation of the first driver 124 has already been started, the stop and restart of the suction force are preferably made by opening or closing the shutter device 126. In addition, in the present embodiment, the second suction unit 140 is configured to move automatically responsive to the size information L of the conveyed medium 101, so that the range where the suction force of the second suction unit 140 exerts, varies depending on the size of the conveyed medium 101A. Specifically, the range where the suction force is exerted on the trailing edge 101Ab of the conveyed medium 101A can be set to an optima position in accordance with the size of the conveyed medium 101A, thereby obtaining an optimal separation in accordance with various sizes of the conveyed medium 101.

Third Embodiment

Figure 21A:
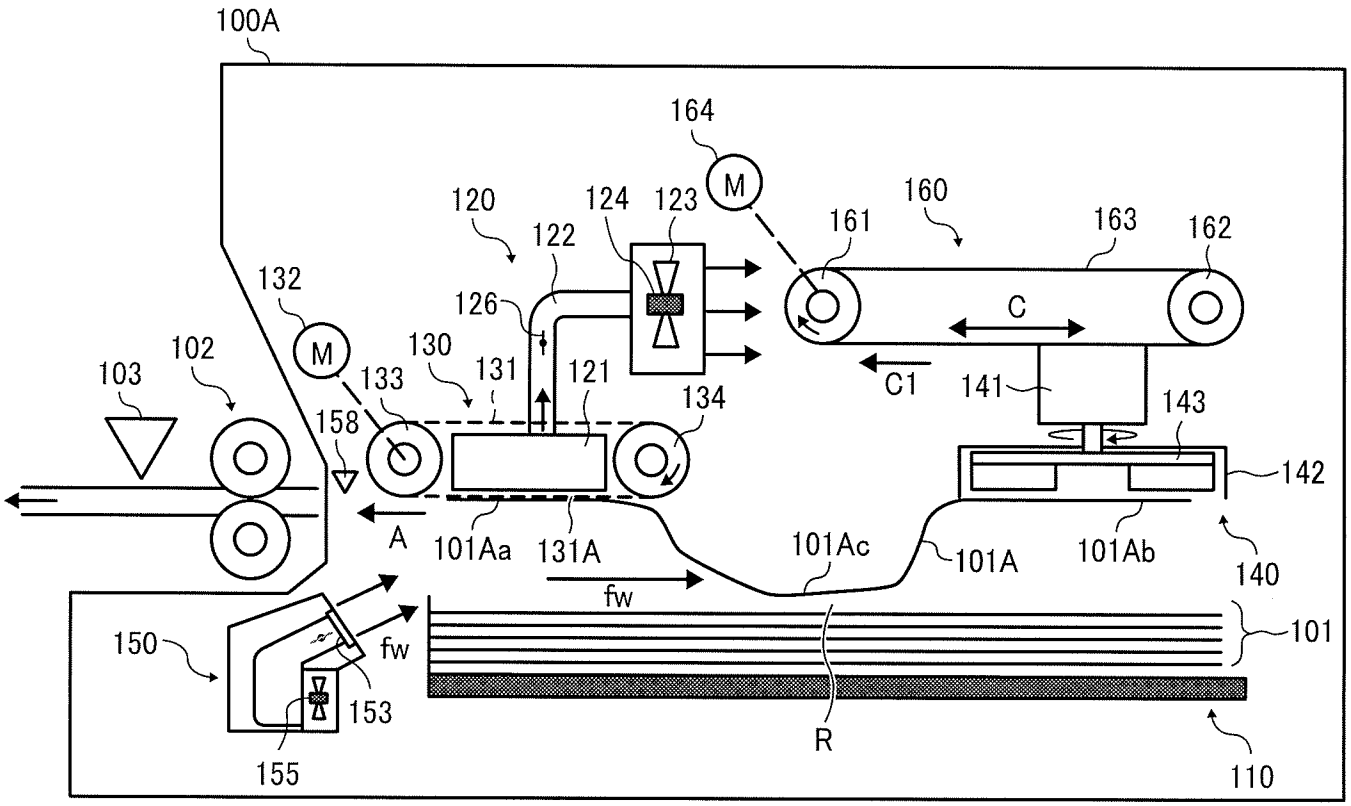
FIGS. 21A and 21B schematically illustrate another embodiment of the second suction unit due to the moving device.
Figure 21B:
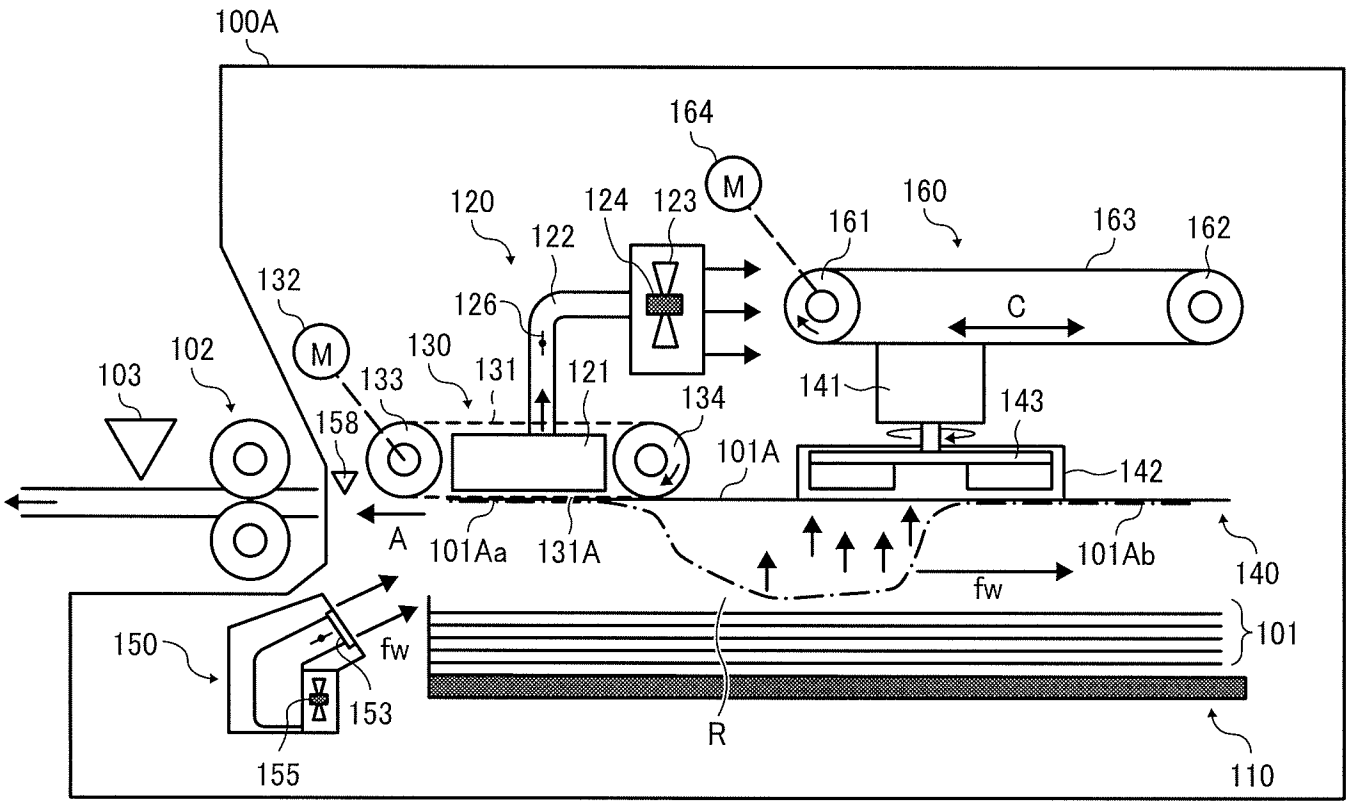

The third embodiment relates to another moving control performed by the moving device 160 as described in the second embodiment. In the second embodiment, the predetermined shift amount T1 of the moving device 160 is changed in accordance with the size information L (i.e., length) of the conveyed medium 101, so that the range and position where the suction force generated by the second suction unit 140 exerts are changed. However, when the conveyed medium 101 is exceptionally thin, has no rigidity, or is exceptionally long in the longer side relative to the shorter side, and when the trailing edge 101Ab of the conveyed medium 101A is attracted, the center 101Ac of the conveyed medium 101A is bent as illustrated in FIG. 21A. As a result, the air path R of the airflow "fw" blown from the fan 150 is not formed properly. That is, the bent portion of the center 101Ac disturbs the flow of the airflow "fw". To handle such a conveyed medium 101 (101A) having an exceptional size, as illustrated in FIG. 21B, if the center 101Ac is attracted not the trailing edge 101Ab, the air path R1 is not disturbed, the separation is improved, generation of misfeed is prevented, and the separation time can be reduced.

Thus, in the third embodiment, the shift amount control unit 212 to arbitrarily set the shift amount of the moving device 160 is employed, to thereby adjust a position of the second suction unit 140. Specifically, in the present embodiment, the shift amount control unit 212 to arbitrarily set the shift amount of the moving device 160 is disposed, and the controller 200A controls operation of the conveyor belt drive motor 164 of the moving device 160 such that the position of the second suction unit 140 is adjusted to be the shift amount set in the shift amount control unit 212. For example, after the control according to the second embodiment, when the operator visually recognizes any defective conveyance of the conveyed medium 101A in the conveyance direction A, the operator operates the switch 212*a* of the shift amount control unit 212 as illustrated in FIG. 16 to set the shift amount of the second suction unit 140 in a reducing direction (or in the minus direction), and the conveyor belt drive motor 164 operates to move the second suction unit 140 in the approaching direction C1, so that the center 101Ac of the conveyed medium 101A can be attracted. In addition, although the second suction unit 140 is positioned at a position corresponding to the size information L, it can be thought that the fine adjustment is necessary depending on the type of the conveyed medium 101. In this case, the operator arbitrarily operates the switch 212*a* or 212*b* to thereby set the shift amount, so that the second suction unit 140 can be positioned at a position suitable for the size and type of the conveyed medium 101A (101). Thus, separation to the different sizes and types of the conveyed media is improved, thereby further reducing generation of the misfeed and separation time. It is noted that, in the present embodiment, the shift amount control unit 212 is displayed on the display 103; however, a numeric inputting device such as a numeric keypad may be employed as a shift amount control unit 212.

Fourth Embodiment

Figure 22:
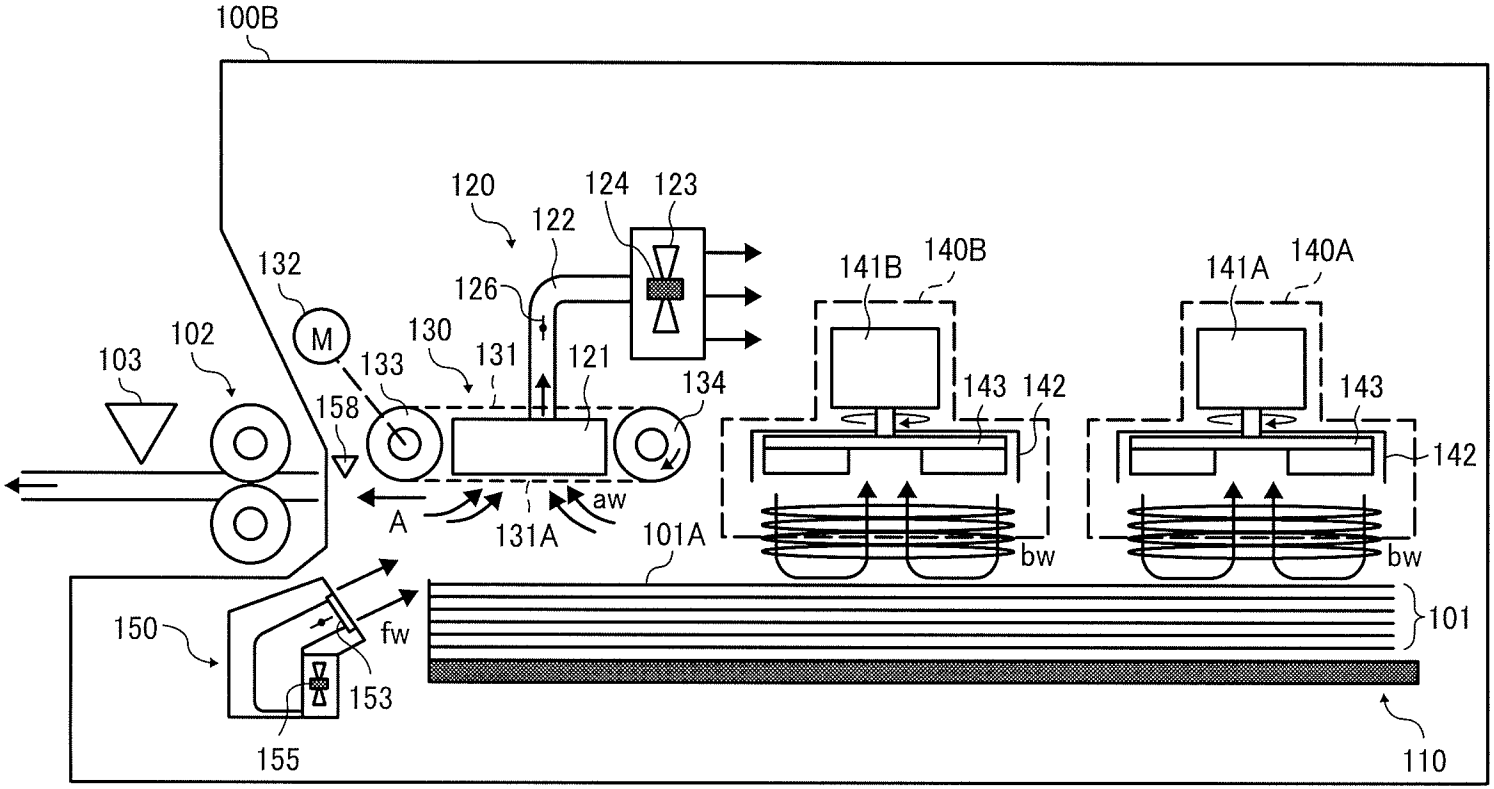
FIG. 22 schematically illustrates a structure of the feeding device according to a fourth embodiment of the present disclosure.

In the second and third embodiments, the position of the second suction unit 140 in the conveyance direction A can be changed by the moving device 160, so that the second suction unit 140 can exert the suction force at a position corresponding to various types such as the length, size, rigidity, and thickness of the conveyed medium 101. In the fourth embodiment, as illustrated in FIG. 22, without moving the second suction unit 140, a plurality of second suction units 140 disposed upstream of the first suction unit 120 in the conveyance direction is employed. In the present embodiment, two second suction units 140 are disposed upstream of the first suction unit 120 in the conveyance direction and are disposed in series in the conveyance direction A. In the present embodiment, the second suction unit disposed upstream in the conveyance direction is the upstream second suction unit 140A, and the second suction unit disposed downstream of the upstream second suction unit 140 in the conveyance direction is the downstream second suction unit 140B.

Figure 23:
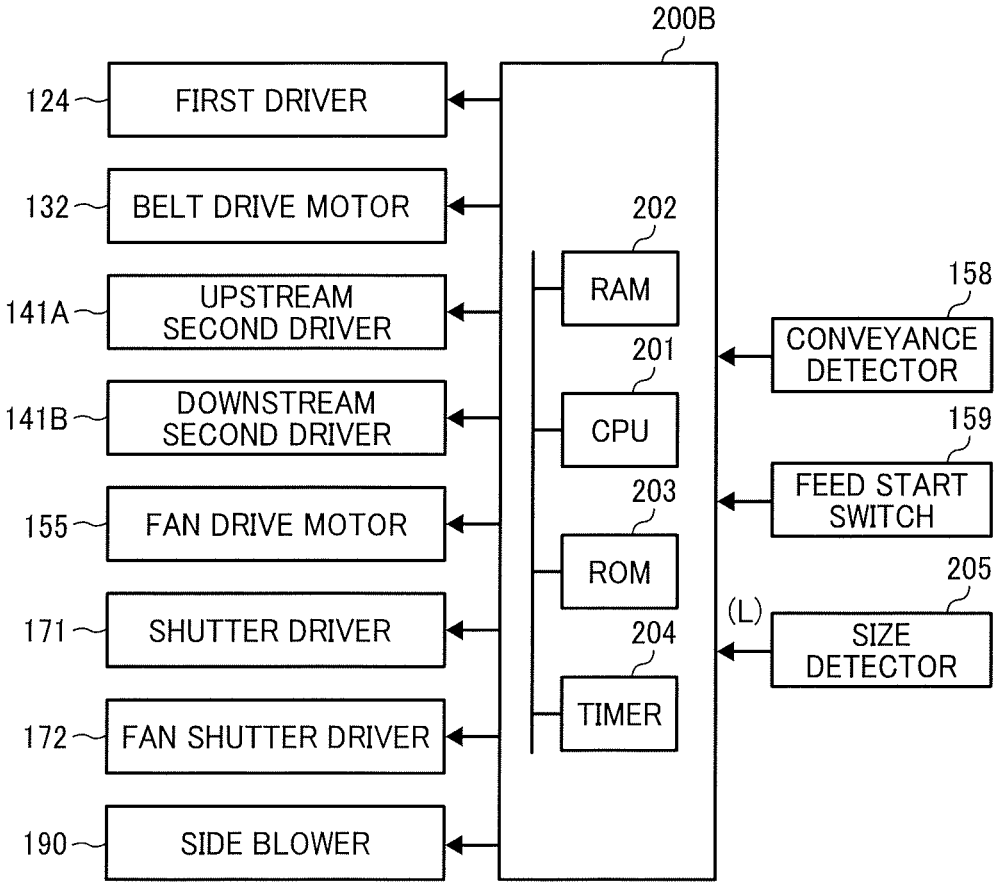
FIG. 23 is a block diagram illustrating a structure of a control system according to the fourth embodiment.

In the fourth embodiment, the upstream second suction unit 140A is disposed at a position corresponding to the trailing edge 101Ab of the maximum-sized conveyed medium 101A feedable in a feeding device 100B, and the downstream second suction unit 140B is disposed between the first suction unit 120 and the upstream second suction unit 140A. FIG. 23 is a block diagram illustrating a structure of the control system by a controller 200B according to the fourth embodiment. The feeding device 100B includes a controller 200B. The controller 200B includes a computer that includes the CPU 201, the RAM 202, the ROM 203, and the timer 204. At an input side of the controller 200B, the conveyance detector 158, the feed start switch 159, and the size detector 205 to detect size information L of the conveyed medium 101 are connected to the controller 200B via signal lines. At an output side of the controller 200B, the first driver 124, the belt drive motor 132, an upstream second driver 141A of the upstream second suction unit 140A, a downstream second driver 141B of the downstream second suction unit 140B, the fan drive motor 155, the shutter driver 171, the fan shutter driver 172, and the side blower 190 are connected via signal lines.

Figure 24:
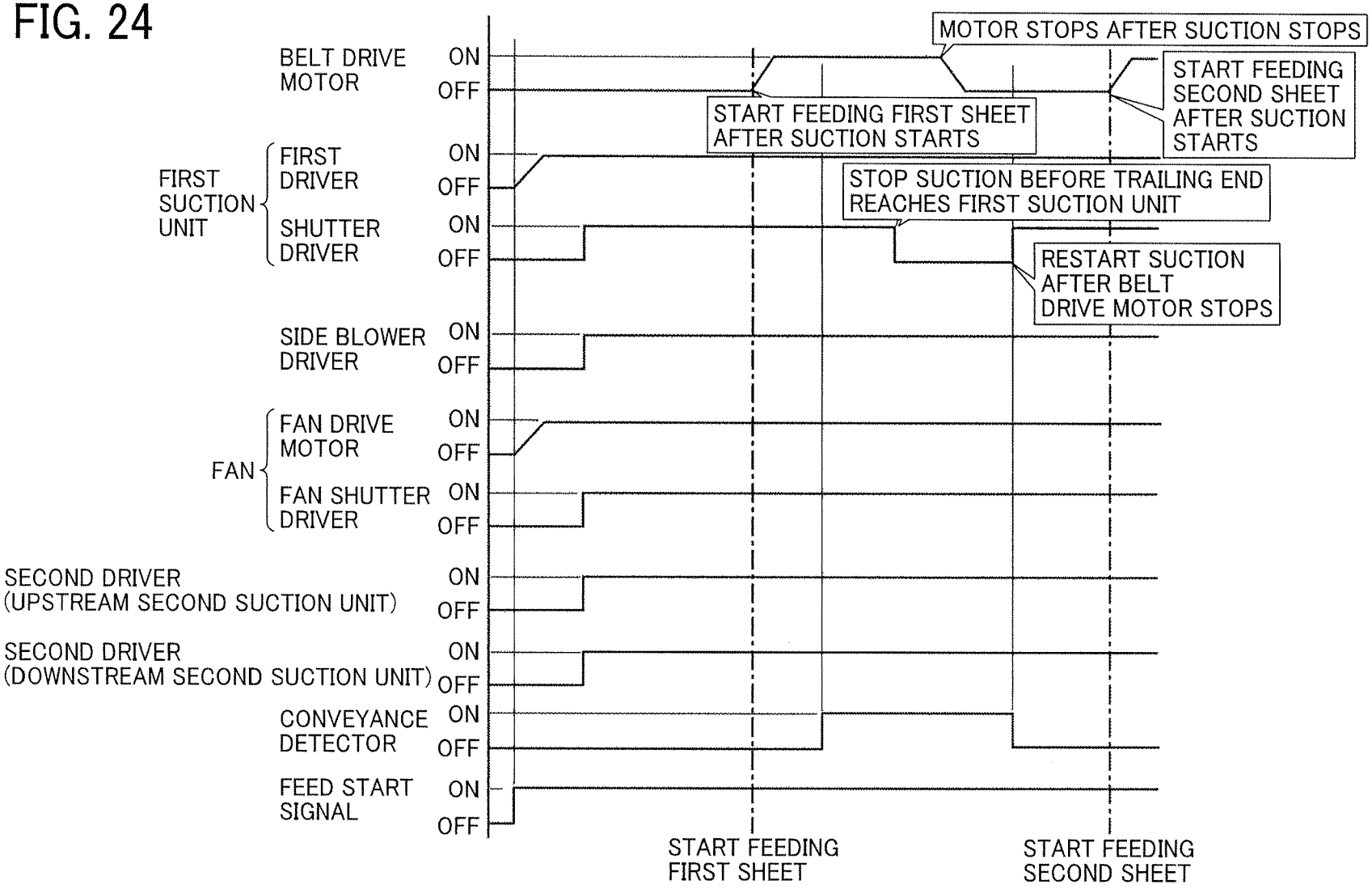
FIG. 24 illustrates an operational timing chart of each part in the feeding device according to the fourth embodiment.

FIG. 24 illustrates an operational timing chart of each device of the feeding device 100B. In the present embodiment, excluding that the controller 200B controls the upstream second driver 141A and the downstream second driver 141B to be driven simultaneously, the present timing chart is the same as the timing chart illustrated in FIG. 10. In the present embodiment, the controller 200B illustrated in FIG. 23 is configured such that, when attracting the maximum-sized conveyed medium 101A, the first suction unit 120, the upstream second suction unit 140A, and the downstream second suction unit 140B are operated and the suction force is exerted on cover an entire range in the longitudinal direction of the conveyed medium 101A. Alternatively, the controller 200B is configured such that, when attracting the maximum-sized conveyed medium 101A or the conveyed medium 101A having an exceptional type or largeness, the first suction unit 120 and at least the downstream second suction unit 140B are operated and the suction force is exerted to cover a range from the leading edge 101Aa to the center 101Ac in the longitudinal direction (or the approaching and separating direction C) of the conveyed medium 101.

Thus, when the plurality of second suction units including the upstream second suction unit 140A and the downstream second suction unit 140B are disposed in parallel (or in series) upstream of the first suction unit 120 in the conveyance direction A (or in the approaching and separating direction C), and the operation of the upstream second suction unit 140A and the downstream second suction unit 140B is controlled depending on the size and type of the conveyed medium 101A, the air path R of the airflow "fw" from the fan 150 is not disturbed, the separation related to the conveyed medium 101 with a different size and type is improved, and generation of misfeed and separation time can be reduced.

Fifth Embodiment

Figure 25:
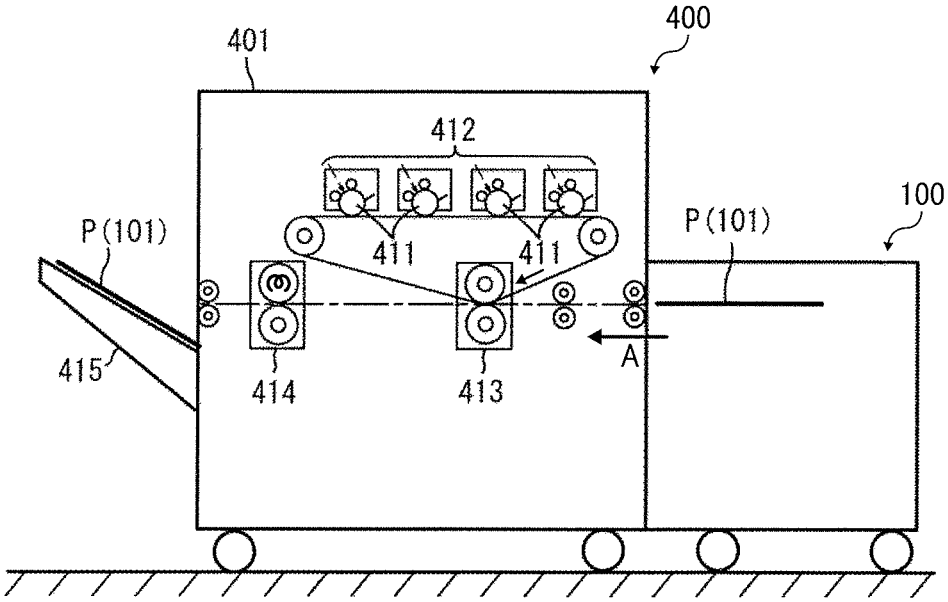
FIG. 25 schematically illustrates a structure of an image forming system according to a fifth embodiment of the present disclosure.

As illustrated in FIG. 25, in the fifth embodiment, any feeding device 100, 100A, or 100B described according to the first to fourth embodiments is applied to an image forming system 400. The image forming system 400 includes an image forming section 401 to form an image on a sheet P that serves as a conveyed medium; and a feeding device to feed the sheet P to the image forming section 401. The feeding device employs, for example, the feeding device 100. The image forming section 401 includes a plurality of process cartridge units 412 each including a drum-shaped image bearer 411. Each of the process cartridge units 412 forms an electrostatic latent image on the image bearer 411, respectively, and toner or a developing agent is adhered onto each of the electrostatic latent image so that the electrostatic latent image is developed as a toner image. The developed toner image is transferred, at a transfer section 413, onto the sheet P, and the toner image is fixed onto the sheet Pat a fixing section 414. The sheet P is then stacked on an ejection tray 415. The above method is called electrophotographic method. The image forming section 401 may employ not only the electrophotographic method, but also inkjet method in which the image is formed on the sheet P by jetting ink from an ink head to the sheet P as a conveyed medium. Whichever method is employed in the image forming section, the topmost sheet P stacked on the stacker 110 is attracted and conveyed from the feeding device 100, via the first suction unit 120 and the second suction unit 140. As a result, the separation of the sheet P is secured, the sheet jams and overlapped conveyance due to following conveyance are prevented, and the separation time can be reduced. Due to the reduced separation time, printing time is reduced, to thereby enable high-speed feeding and structuring a highly-productive image forming system 400 capable of handling a large-sized sheet.

Sixth Embodiment

Figure 26A:
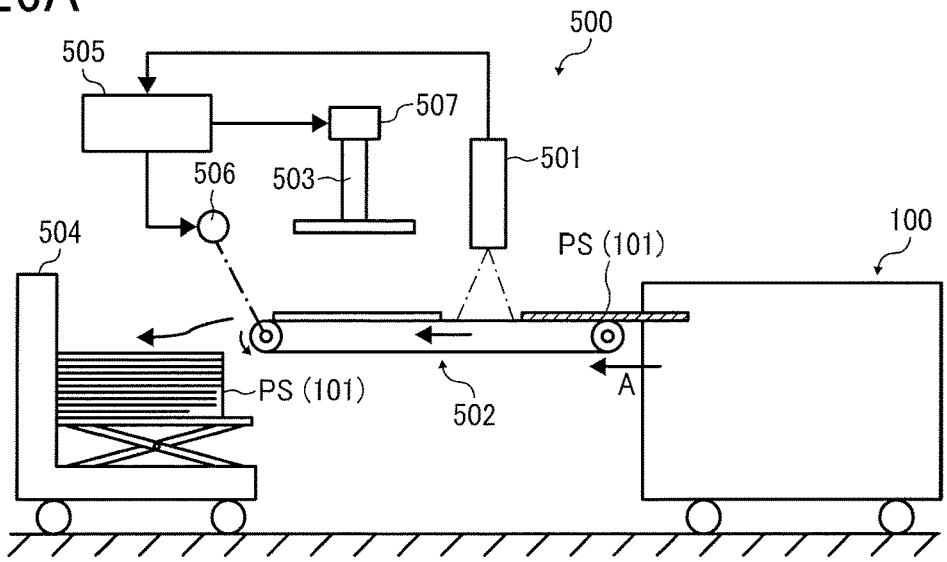
FIGS. 26A-26C schematically illustrate a structure of a conveyed medium inspection system according to a sixth embodiment of the present disclosure.
Figure 26B:
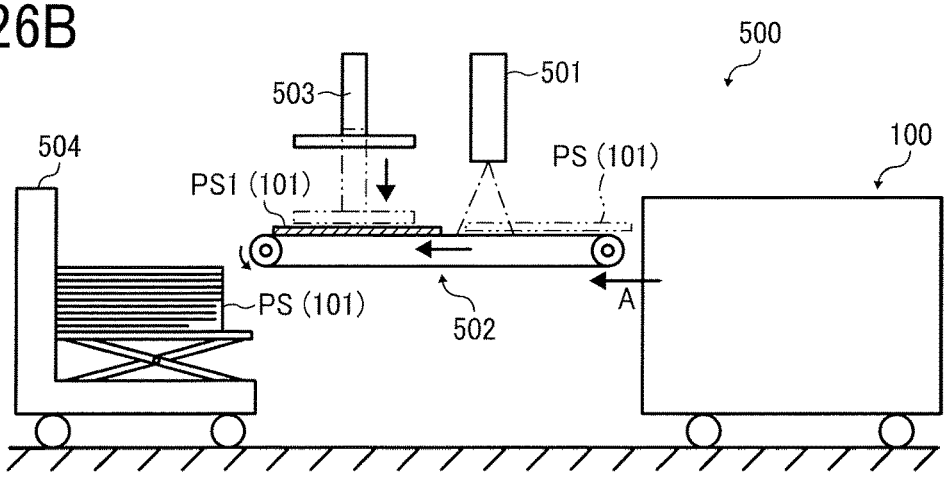
Figure 26C:
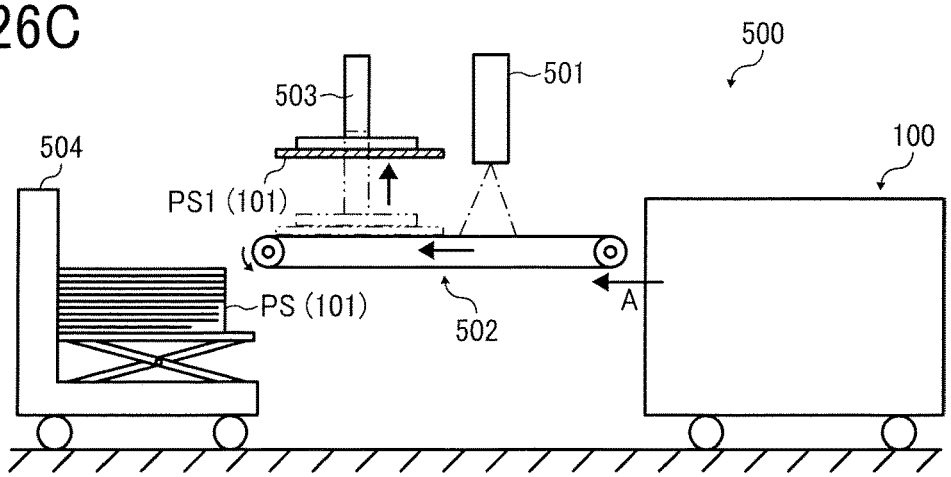

As illustrated in FIGS. 26A to 26C, in the sixth embodiment, any feeding device 100, 100A, or 100B described according to the first to fourth embodiments is applied to a conveyed medium inspection system 500. The conveyed medium inspection system 500 includes an inspection device 501 as an inspection section to inspect, for example, a prepreg sheet PS as a conveyed medium, a feeding device to feed the prepreg sheet PS to the inspection device 501, and a controller 505. The feeding device employs, for example, the feeding device 100. The conveyed medium inspection system 500 includes a sheet conveyor device 502, disposed below the inspection device 501, to convey the prepreg sheet PS. The prepreg sheet PS separated and conveyed by the feeding device 100 moves below the inspection device 501 via the sheet conveyor device 502 as illustrated in FIG. 26A. The inspection device 501 linearly scans scratches on the surface of the prepreg sheet PS or the size of the sheet as image information, and detects a status of the surface while the sheet conveyor device 502 conveying the prepreg sheet PS. The conveyed medium inspection system 500 includes a suction unit 503 disposed downstream of the inspection device 501 in the conveyance direction and upstream of the sheet conveyor device 502. The suction unit 503 adsorbs the prepreg sheet PS1 of which a defective surface is detected by the inspection device 501 as illustrated in FIGS. 26B and 26C. The conveyed medium inspection system 500 includes a stacker 504 disposed downstream of the sheet conveyor device 502 in the conveyance direction. The stacker 504 is used to stack the prepreg sheet PS without a defective surface among the prepreg sheets PS conveyed by the sheet conveyor device 502, that is, the prepreg sheet PS not attracted by the suction unit 503.

As illustrated in FIG. 26A, the inspection device 501, a drive motor 506 as a power source of the sheet conveyor device 502, and an suction unit drive source 507 of the suction unit 503 are connected to the controller 505 via signal lines. The controller 505 determines whether the conveyed prepreg sheet PS is good or not by the image information sent from the inspection device 501. When the prepreg sheet PS detected by the inspection device 501 is defective (PS1), the controller 505 operates the suction unit drive source 507 of the suction unit 503 to exert a suction force onto the sheet conveyor device 502. As a result, the prepreg sheet PS1 determined as a defective sheet is removed from the sheet conveyor device 502 by the suction unit 503. As described heretofore, while passing through the first suction unit 120, and the second suction unit 140 from the feeding device 100, the topmost prepreg sheet PS among stacked sheets is attracted and conveyed, the separation of the prepreg sheet PS is secured, jams and overlapped conveyance of the prepreg sheet due to the following conveyance can be prevented, and thus, the separation time can be reduced. The reduction in the separation time leads to a reduction of the inspection time of the prepreg sheet PS, to thereby deal with a high-speed conveyance, so that the highly productive conveyed medium inspection system 500 can be structured.

Various embodiments of the present disclosure have been described heretofore; however, the present disclosure is not limited to any specific embodiment, but may be variously modified and changed within the scope of the present disclosure described in the scope of claims unless limited particularly in the above description. Exemplary conveyed media 101 according to the present embodiments are not limited to the sheet P and resinous sheet material such as the prepreg sheet PS, but may include a recording sheet, a film, or fabrics. Specifically, the conveyed medium 101 may refer to any sheet-shaped adsorbable conveyed medium such as a sheet, a recording medium, an OHP, a prepreg, and copper foils.

Additional modifications and variations of the present disclosure are possible in light of the above teachings. It is therefore to be understood that, within the scope of the appended claims, the disclosure may be practiced other than as specifically described herein.

What is claimed is:

1. A feeding device comprising:

a conveyance device to convey a conveyed medium in a conveyance direction of the conveyed medium;

a first suction unit disposed and configured to apply a suction force to attract a leading edge of the conveyed medium from a stacked position of the conveyed medium towards the conveyance device, the first suction unit including:

a suction chamber;

a suction fan disposed downstream in an air flow direction of, and external to, the suction chamber, to draw air from the suction chamber;

a first driver to rotate the suction fan; and a second suction unit disposed upstream, in the conveyance direction, of the first suction unit and configured to generate a vortex air directed to the conveyed medium, the second suction unit including:

a rotary fan including a board having a planar surface and a plurality of walls attached on the planar surface of the board; and a second driver to rotate the rotary fan, wherein the first suction unit and the second suction unit are different types of suction devices and are disposed above the conveyed medium stacked on a stacker to attract the conveyed medium, operation of the suction fan, which is downstream in the air flow direction of, and external to, the suction chamber, causing a negative pressure to be generated in the suction chamber and thereby drawing air flow to apply the suction force attracting the leading edge of the conveyed medium from the stacked position of the conveyed medium, and the second suction unit generating a suction force that is stronger than that generated by the first suction unit, and wherein the second suction unit is disposed (i) laterally to the conveyance device in a direction parallel to the conveyance direction.

2. The feeding device according to claim 1, further comprising a moving device to retain the second suction unit to be movable in parallel with the conveyance direction of the conveyed medium.

3. The feeding device according to claim 2, further comprising:

a size detector to detect size information of the conveyed medium; and a controller to control operation of the moving device until the second suction unit takes a predetermined position based on the size information of the conveyed medium.

4. The feeding device according to claim 3, further comprising:

a shift amount control unit to arbitrarily set a shift amount of the moving device, wherein the controller controls operation of the moving device until the moving device moves by the shift amount set in the shift amount control unit.

5. An image forming system comprising:

an image forming section; and the feeding device according to claim 1, to feed the conveyed medium to the image forming section.

6. A conveyed medium inspection system comprising:

an inspection device to inspect the conveyed medium; and the feeding device according to claim 1, to feed the conveyed medium to the inspection device.

7. The feeding device according to claim 1, further comprising:

a moving device to move the second suction unit in a direction parallel to the conveyance direction of the conveyed medium; and a controller to control operation of the moving device until the second suction unit takes a predetermined position within a range where a suction force is exerted on an upstream end, in the conveyance direction, of the conveyed medium.

8. The feeding device according to claim 1, wherein the first suction unit further includes:

a suction duct via which the suction fan draws air by air aspiration from the suction chamber; and a shutter device to control flow of the air drawn through the suction duct to the suction fan.

9. The feeding device according to claim 1, further comprising a fan disposed at the first suction unit to blow air to an end of the conveyed medium before suction.

10. A feeding device to feed a conveyed medium stacked on a stacker and to be conveyed in a conveyance direction away from the feeding device, the feeding device comprising:

a first suction unit disposed and configured to apply a suction force to attract a leading edge of the conveyed medium from a stacked position of the conveyed medium, the first suction unit including:

a suction chamber;

a suction fan disposed downstream in an air flow direction of, and external to, the suction chamber to draw air from the suction chamber; and a first driver to rotate the suction fan;

a second suction unit disposed upstream, in the conveyance direction, of the first suction unit and configured to generate a vortex air directed to the conveyed medium, including:

a rotary fan including a board having a planar surface and a plurality of walls attached on the planar surface of the board; and a second driver to rotate the rotary fan;

a moving device to move the second suction unit in a direction parallel to the conveyance direction of the conveyed medium; and a controller to control operation of the moving device until the second suction unit takes a predetermined position within a range where a suction force is exerted on an upstream end, in the conveyance direction, of the conveyed medium, wherein the first suction unit and the second suction unit are different types of suction devices and are disposed above the conveyed medium stacked on the stacker to attract the conveyed medium, operation of the suction fan, which is downstream in the air flow direction of, and external to, the suction chamber, causing a negative pressure to be generated in the suction chamber and thereby drawing air flow to apply the suction force attracting the leading edge of the conveyed medium from the stacked position of the conveyed medium, and the second suction unit generating a suction force that is stronger than that generated by the first suction unit, and wherein the second driver of the second suction unit is attached to a surface of the moving device which opposes at least a portion of the conveyed medium stacked on the stacker.

11. The feeding device according to claim 10, further comprising a moving device to retain the second suction unit to be movable in parallel with a conveyance direction of the conveyed medium.

12. The feeding device according to claim 11, further comprising:

a size detector to detect size information of the conveyed medium, wherein the controller controls operation of the moving device until the second suction unit takes a predetermined position based on the size information of the conveyed medium.

13. The feeding device according to claim 12, further comprising:

a shift amount control unit to arbitrarily set a shift amount of the moving device, wherein the controller controls operation of the moving device until the moving device moves by the shift amount set in the shift amount control unit.

14. The feeding device according to claim 10, wherein the first suction unit further includes:

a suction duct via which the suction fan draws air by air aspiration from the suction chamber; and a shutter device to control flow of the air drawn through the suction duct to the suction fan.

15. An image forming system comprising:

an image forming section; and the feeding device according to claim 10, to feed the conveyed medium to the image forming section.

16. A conveyed medium inspection system comprising:

an inspection device to inspect the conveyed medium; and the feeding device according to claim 10, to feed the conveyed medium to the inspection device.

17. A feeding device to feed a conveyed medium stacked on a stacker and to be conveyed in a conveyance direction away from the feeding device, the feeding device comprising:

a first suction unit disposed and configured to apply a suction force to attract a leading edge of the conveyed medium from a stacked position of the conveyed medium, the first suction unit including:

a suction chamber;

a suction fan disposed downstream in an air flow direction of, and external to, the suction chamber to draw air from the suction chamber; and a first driver to rotate the suction fan;

a second suction unit disposed upstream, in the conveyance direction, of the first suction unit and configured to generate a vortex air directed to the conveyed medium, the second suction unit including:

a rotary fan including a board having a planar surface and a plurality of walls attached on the planar surface of the board; and a second driver to rotate the rotary fan; and a controller to control operations of the first suction unit and the second suction unit, wherein upon receiving a feed start command, the controller activates the first driver to start rotating the suction fan to draw air from the suction chamber and thereby apply the suction force to attract the leading edge of the conveyed medium from the stacked position of the conveyed medium, and then activates the second driver to rotate the rotary fan to generate the vortex air directed to attract a trailing edge of the conveyed medium, wherein when the second driver is activated, the second suction unit generates the vortex air directed to attract the trailing edge of the conveyed medium and generates a suction force that is stronger than that generated by the first suction unit.

18. The feeding device according to claim 17, further comprising:

a conveyance device including a conveyor belt and a belt driver, wherein after the second suction unit starts to generate the vortex air directed to attract the trailing edge of the conveyed medium to the conveyor belt, the controller activates the belt driver to start rotating the conveyor belt.

19. The feeding device according to claim 18, further comprising:

a conveyance detector disposed downstream of the first suction unit to detect the conveyed medium and output a detection signal indicating that the conveyance detector detects the conveyed medium, wherein the first suction unit further includes:

a suction duct via which the suction fan draws air by air aspiration from the suction chamber;

a shutter device to control flow of the air drawn into the suction duct, to the suction fan; and a shutter driver to operate the shutter to open or close the suction duct, and wherein when the controller determines that the detection signal indicating detection of the conveyed medium by the conveyance detector has lasted continuously for a predetermined time period, the controller stops operation of the belt driver and thereby stop rotation of the conveyor belt and stops operation of the shutter driver and thereby close the suction duct.

20. The feeding device according to claim 17, further comprising:

a blower disposed to blow air to a leading end of the conveyed medium stacked on the stacker, the blower including a blower fan and a fan driver to rotate the blower fan, wherein upon receiving the feed start command, the controller activates the first driver and activates the fan driver to start rotating the blower fan, airflow from the air blown by the blower fan lifting the leading end of the conveyed medium, and then the controller activates activates the second driver to generate the vortex air to attract the trailing edge of the conveyed medium.

* * * * *